US012774074B2

(12) United States Patent
Iwata et al.

(10) Patent No.: US 12,774,074 B2
(45) Date of Patent: Oct. 27, 2026

(54) JET PROPULSION BOAT AND METHOD OF CONTROLLING JET PROPULSION BOAT

(71) Applicant: KAWASAKI MOTORS, LTD., Hyogo (JP)

(72) Inventors: Tetsuya Iwata, Akashi (JP); Toshio Araki, Akashi (JP); Yoshihito Uchino, Akashi (JP); Yoshiyuki Kuroyanagi, Akashi (JP)

(73) Assignee: KAWASAKI MOTORS, LTD., Hyogo (JP)

( * ) Notice: Subject to any disclaimer, the term of this patent is extended or adjusted under 35 U.S.C. 154(b) by 229 days.

(21) Appl. No.: 18/806,695

(22) Filed: Aug. 16, 2024

(65) Prior Publication Data

US 2026/0048828 A1 Feb. 19, 2026

(51) Int. Cl.
*B63H 11/11* (2006.01)
*B63H 11/00* (2006.01)
*B63H 21/21* (2006.01)

(52) U.S. Cl.
CPC ..... *B63H 21/21* (2013.01); *B63H 11/11* (2013.01); *B63H 2011/008* (2013.01)

(58) Field of Classification Search
CPC .... B63H 21/21; B63H 11/11; B63H 2011/008
USPC ..... 440/1, 2, 3, 4, 6, 38
See application file for complete search history.

(56) References Cited

U.S. PATENT DOCUMENTS

| | | | | |
|---|---|---|---|---|
| 6,142,841 | A * | 11/2000 | Alexander, Jr. | B63H 25/46 114/151 |
| 2013/0102206 | A1* | 4/2013 | Fujino | B63H 25/04 440/1 |
| 2023/0139789 | A1* | 5/2023 | Ikegaya | B63H 21/21 440/1 |
| 2023/0257090 | A1* | 8/2023 | Murayama | B63H 11/11 440/41 |
| 2024/0278893 | A1* | 8/2024 | Araki | B63H 11/08 |
| 2025/0256821 | A1* | 8/2025 | Miwa | B63H 11/11 |

* cited by examiner

*Primary Examiner* — Tye William Abell
(74) *Attorney, Agent, or Firm* — XSENSUS LLP

(57) ABSTRACT

A jet propulsion boat includes a boat body; a main propulsion device including a jet device that jets a jet water stream from the boat body, and a direction change device that changes, in a lateral direction, an orientation of the jet water stream having been jetted; an auxiliary propulsion device provided on the boat body to impart a propulsion force in a lateral direction to the boat body; and a control device that controls the main propulsion device and the auxiliary propulsion device, and switches a control mode of the main propulsion device and the auxiliary propulsion device between a plurality of modes, in which the control mode includes a main control mode for driving the main propulsion device and stopping the auxiliary propulsion device to move the boat body, and a combined mode for driving both the main propulsion device and the auxiliary propulsion device to move the boat body.

19 Claims, 22 Drawing Sheets

FIG.10

| PATTERN | THRUSTER MOTOR (WATER STREAM ORIENTATION) | JET NOZZLE POSITION | REVERSE BUCKET POSITION | TRAVELING DIRECTION | |
|---|---|---|---|---|---|
| FRONT SLIDE | STOP | BASIC POSITION | F | FRONT | |
| REAR SLIDE | STOP | BASIC POSITION | R | REAR | |
| RIGHT FRONT SLIDE | FORWARD ROTATION (LEFT ORIENTATION WATER STREAM) | FIRST POSITION | F | DIAGONALLY RIGHT FORWARD | |
| RIGHT SLIDE | FORWARD ROTATION (LEFT ORIENTATION WATER STREAM) | FIRST POSITION | N | RIGHT | |
| RIGHT REAR SLIDE | FORWARD ROTATION (LEFT ORIENTATION WATER STREAM) | FIRST POSITION | R | DIAGONALLY RIGHT REARWARD | |
| LEFT FRONT SLIDE | BACKWARD ROTATION (RIGHT ORIENTATION WATER STREAM) | SECOND POSITION | F | DIAGONALLY LEFT FORWARD | |
| LEFT SLIDE | BACKWARD ROTATION (RIGHT ORIENTATION WATER STREAM) | SECOND POSITION | N | LEFT | |
| LEFT REAR SLIDE | BACKWARD ROTATION (RIGHT ORIENTATION WATER STREAM) | SECOND POSITION | R | DIAGONALLY LEFT REARWARD | |

FIG.22

| JOYSTICK OPERATION | ENGINE THRUSTER | NOZZLE POSITION | BUCKET POSITION | TARGET TRAVELING DIRECTION |
|---|---|---|---|---|
| | ENGINE : STOP THRUSTER : FORWARD ROTATION | BASIC POSITION | N | CLOCKWISE |
| | ENGINE : STOP THRUSTER : BACKWARD ROTATION | BASIC POSITION | N | COUNTER CLOCKWISE |
| | FRONT SLIDE PATTERN | | | FRONT |
| | REAR SLIDE PATTERN | | | REAR |
| | RIGHT FRONT SLIDE PATTERN | | | DIAGONALLY RIGHT FORWARD |
| | RIGHT SLIDE PATTERN | | | RIGHT |
| | RIGHT REAR SLIDE PATTERN | | | DIAGONALLY RIGHT REARWARD |
| | LEFT FRONT SLIDE PATTERN | | | DIAGONALLY LEFT FORWARD |
| | LEFT SLIDE PATTERN | | | LEFT |
| | LEFT REAR SLIDE PATTERN | | | DIAGONALLY LEFT REARWARD |

JET PROPULSION BOAT AND METHOD OF CONTROLLING JET PROPULSION BOAT

FIELD OF INVENTION

The present disclosure relates to a jet propulsion boat that moves on water and a method of controlling the jet propulsion boat.

BACKGROUND ART

As a type of jet propulsion boat, a jet propulsion boat described in US2013/0102206A1 is known. In order to improve the convenience of the jet propulsion boat, it is desired to increase a degree of freedom in operation.

SUMMARY OF THE INVENTION

The present disclosure has been made in view of the above-described circumstance, and an object of the present disclosure is to provide a jet propulsion boat having a high degree of freedom in operation.

As a solution for the problem, a jet propulsion boat according to one aspect of the present disclosure is a jet propulsion boat including: a boat body; a main propulsion device including a jet device that jets a jet water stream from the boat body, and a direction change device that changes, in a lateral direction, an orientation of the jet water stream having been jetted; an auxiliary propulsion device provided on the boat body to impart a propulsion force in a lateral direction to the boat body; and a control device that controls the main propulsion device and the auxiliary propulsion device, and switches a control mode of the main propulsion device and the auxiliary propulsion device between a plurality of modes, in which the control mode includes a main control mode for driving the main propulsion device and stopping the auxiliary propulsion device to move the boat body, and a combined mode for driving both the main propulsion device and the auxiliary propulsion device to move the boat body.

BRIEF DESCRIPTION OF THE DRAWINGS

FIG. 10 is a tabular view showing a control aspect of each device and a traveling direction of a boat body in each slide pattern;

FIG. 22 is a tabular view showing a relationship between an operation direction of the joystick and an operation of each device.

DETAILED DESCRIPTION

Figure 1:
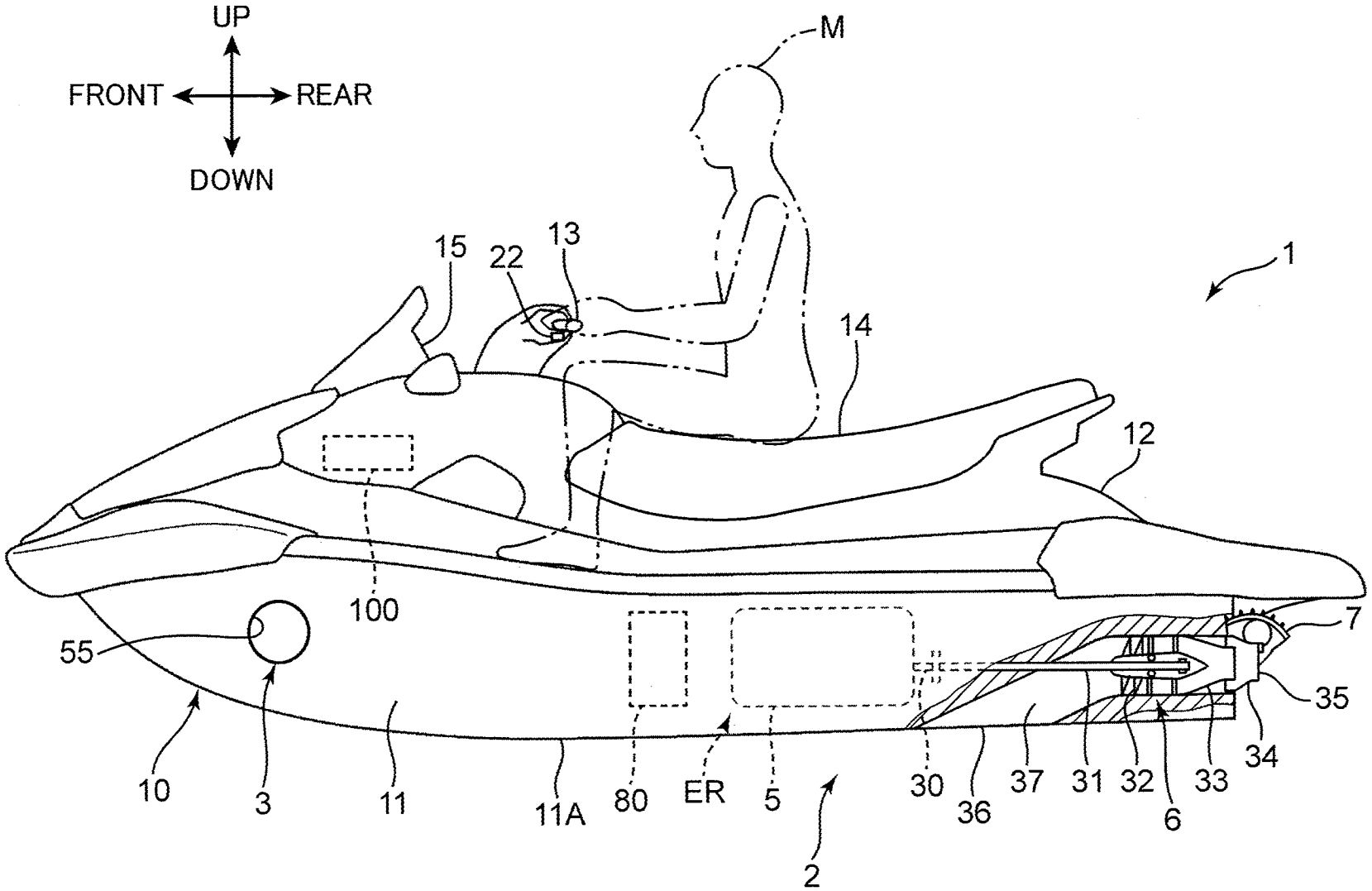
FIG. 1 is a partially broken side view of a jet propulsion boat according to an embodiment of the present disclosure.

Embodiments of a jet propulsion boat according to the present disclosure will be described below with reference to the drawings. In the following description, the front-rear direction of the boat body of the jet propulsion boat, specifically, the longitudinal direction of the boat body, the direction connecting the bow and the stern, is simply called the front-rear direction, and the bow side is called front and the stern side is called rear. The lateral direction of the boat body of the jet propulsion boat, specifically, a width direction of the boat body, the direction orthogonal to the front-rear direction and a vertical direction, is called the lateral direction. Note that the front-rear and lateral directions coincide with front-rear and lateral directions as viewed from the driver aboard the jet propulsion boat. Front, rear, left, and right direction indications in the drawings indicate directions defined as described above.

[Configuration of Jet Propulsion Boat]

Figure 2:
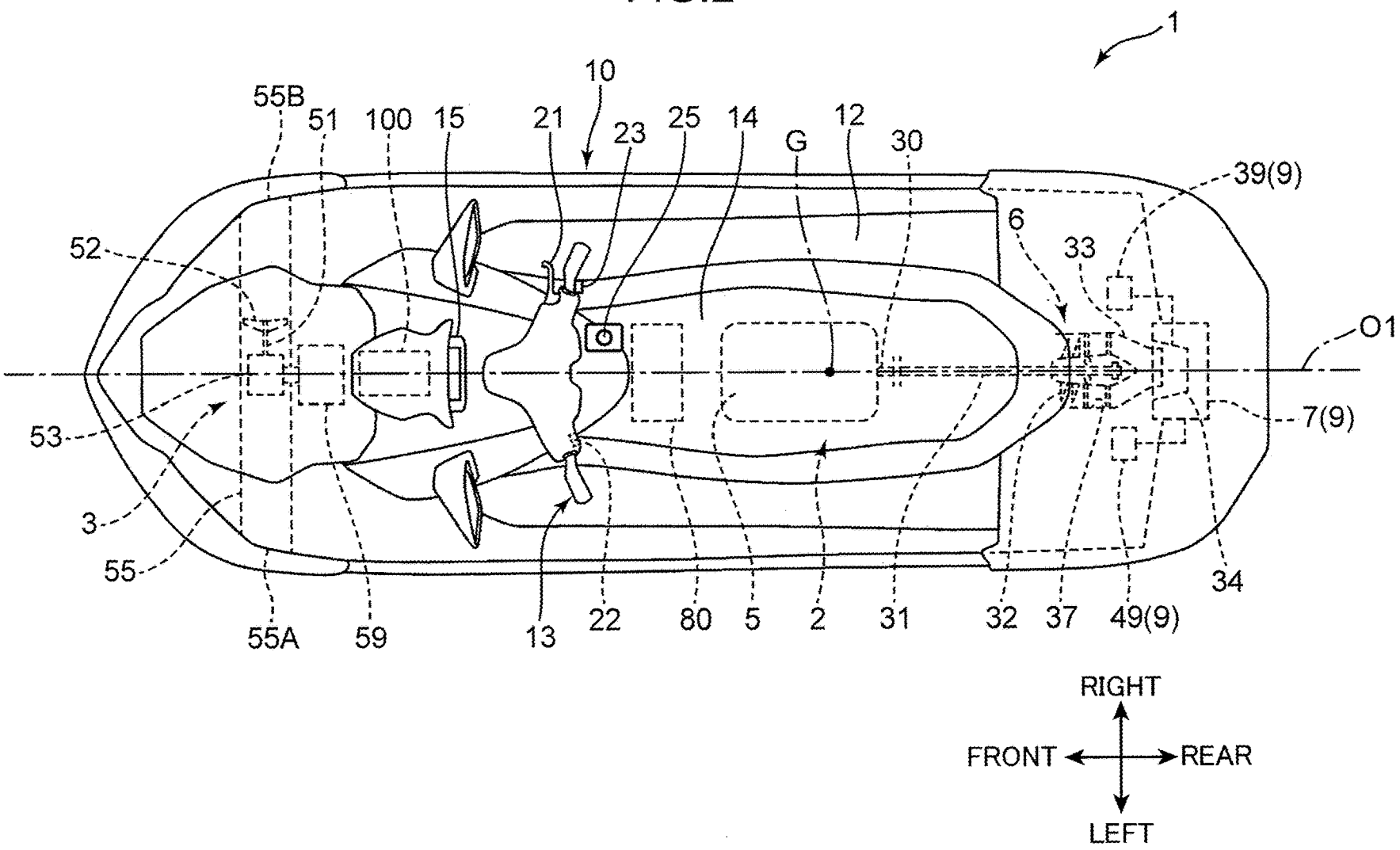
FIG. 2 is a plan view of the jet propulsion boat.

FIG. 1 is a partially broken side view of a jet propulsion boat 1 according to an embodiment of the present disclosure, and FIG. 2 is a plan view of the jet propulsion boat 1. The jet propulsion boat 1 is a watercraft that jets a water stream rearward and moves on water in reaction to the water stream. In the present embodiment, the jet propulsion boat 1 is a straddle-type personal watercraft also called a PWC. For this reason, hereinafter, the jet propulsion boat 1 is abbreviated as the PWC 1.

The PWC 1 includes, as propulsion devices that impart a propulsion force to a boat body 10, a main propulsion device 2, and an auxiliary propulsion device 3 that imparts a propulsion force different from that of the main propulsion device 2 to the boat body 10. The main propulsion device 2 is an engine-type propulsion device and includes an engine 5 as a drive source. The auxiliary propulsion device 3 is an electric-type propulsion device and includes a thruster motor 59 including an electric motor as a drive source. Here, the main propulsion device 2 generates a propulsion force by drive of the engine 5. Hereinafter, drive/stop of the main propulsion device 2 is simply called drive/stop of the engine 5. By drive of the thruster motor 59, the auxiliary propulsion device 3 generates a propulsion force. Hereinafter, drive/stop of the auxiliary propulsion device 3 is simply called drive/stop of the thruster motor 59.

The boat body 10 includes a hull 11 and a deck 12 overlying the hull 11.

A front upper part of the deck 12 is provided with a steering handle 13. The steering handle 13 is an operation device operated by a driver M. As shown in FIG. 2, the steering handle 13 is provided with an accelerator 21 and a start/stop switch 22, and the deck 12 is provided with a shift lever 23 and a joystick 25 that are operated by the driver M. The start/stop switch 22 is a switch for starting the engine 5 in a stopped state and for stopping the engine 5 in a driven state. Details of the accelerator 21, the shift lever 23, and the joystick 25 will be described later. The joystick 25 corresponds to the "auxiliary operator" in the present disclosure.

A seat 14 and a display 15 are disposed on the deck 12. The seat 14 is a seat on which the driver M who drives the PWC 1 is seated. The seat 14 may be a seat on which at least the driver M can be seated. That is, the seat 14 may be a multiple-passenger seat on which not only the driver M but also passengers can be seated, or may be a single-passenger seat on which only the driver M can be seated. The display 15 is a device that displays various types of information. The display 15 is a touchscreen-type display, and can perform various input operations on the display 15. The boat body 10 is mounted with a battery 80 that feeds power to each electric device mounted on the boat body 10. The display 15 corresponds to the "display device" in the present disclosure.

(Main Propulsion Device)

The main propulsion device 2 includes a jet pump 6 that jets water and the reverse bucket 7 disposed at an outlet of the jet pump 6. As described above, the main propulsion device 2 includes the engine 5 as a drive source. The jet pump 6 is driven by the engine 5 to jet water. The jet pump 6 corresponds to the "jet device" in the present disclosure.

The engine 5 is an internal combustion engine. The engine 5 generates power for driving the jet pump 6. The engine 5 is, for example, a water-cooled four-stroke multicylinder engine using gasoline as fuel. The engine 5 is accommodated in an engine room ER formed inside the hull 11. The engine 5 includes, as an output shaft, a crankshaft 30 extending in the front-rear direction.

The boat body 10 includes an impeller passage 37. The impeller passage 37 is a passage having, as an inlet, a water intake 36 formed at the center in the lateral width direction of a bottom surface 11A of the hull 11. The impeller passage 37 is formed so as to penetrate a rear part of the hull 11 in the front-rear direction.

The jet pump 6 is disposed in the impeller passage 37. The jet pump 6 is a pump that generates a jet water stream. The jet pump 6 includes a pump shaft 31, a pump impeller 32, a Venturi nozzle 33, and a jet nozzle 34.

The pump shaft 31 is coaxially coupled to the rear end of the crankshaft 30. The driving force of the engine 5 is transmitted to the pump impeller 32 via the crankshaft 30 and the pump shaft 31. Upon receiving the driving force, the pump impeller 32 rotates about an axis and generates a rearward water stream.

The Venturi nozzle 33 and the jet nozzle 34 generate a jet water stream by pressurizing and accelerating the water sent from the pump impeller 32. The jet nozzle 34 is a nozzle having a jet port 35 opened rearward as an outlet of a jet water stream. The jet nozzle 34 is coupled to a rear end part of the Venturi nozzle 33. The jet water stream is jetted rearward from the jet port 35 of the jet nozzle 34. The rearward jet of the jet water stream imparts a propulsion force for the boat body 10 to move forward.

The jet nozzle 34 is disposed at the rear end part of the boat body 10 more rearward than a center of gravity G of the PWC 1. The center of gravity G of the PWC 1 is positioned in a region where the seat 14 is disposed. By this, the jet pump 6 and the jet nozzle 34 jet a jet water stream rearward from a position more rearward than the seat 14. The jet nozzle 34 is disposed on the center line O1 in the lateral direction of the boat body 10 in plan view. Due to this, the jet water stream is jetted rearward from the vicinity of a part positioned on the center line O1 in plan view of the rear end part of the boat body 10.

Figure 3:
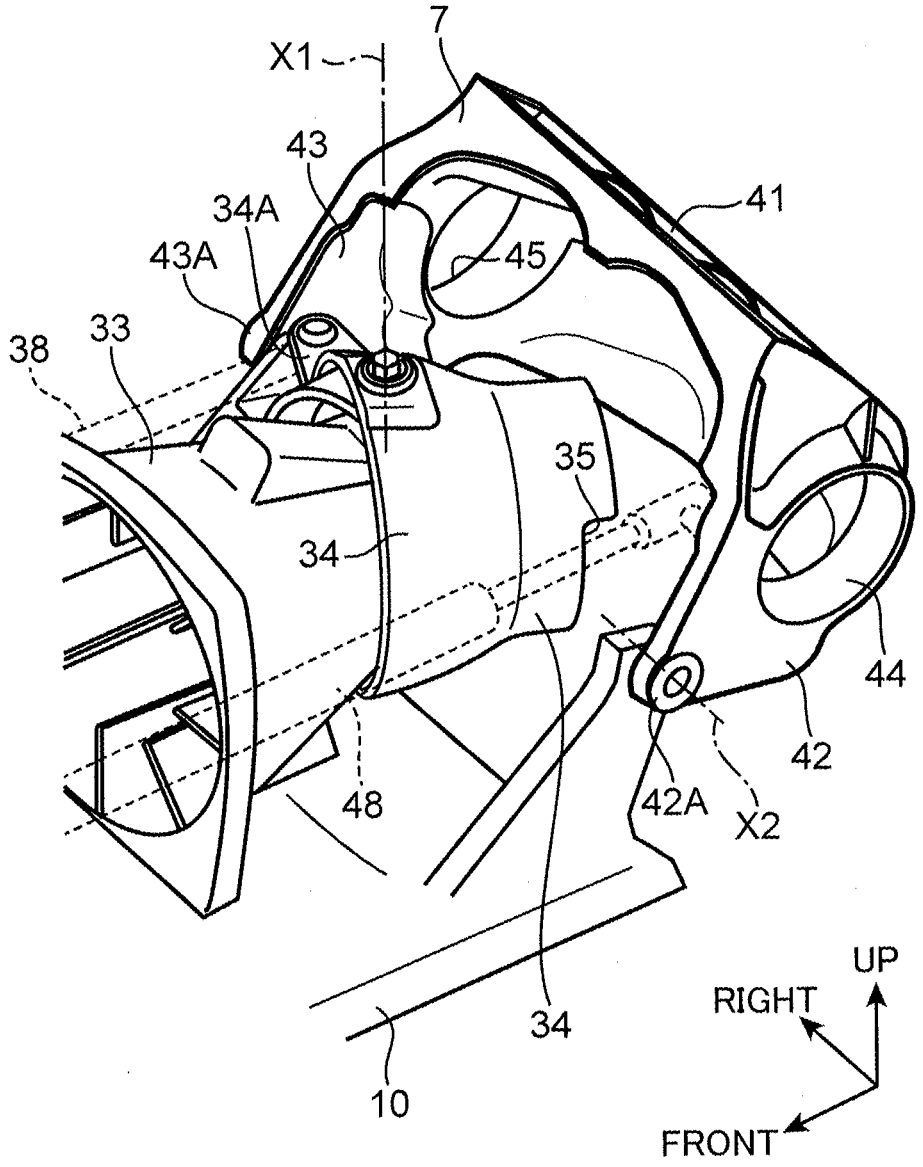
FIG. 3 is a schematic perspective view showing a periphery of a jet nozzle provided in the jet propulsion boat.
Figure 4:
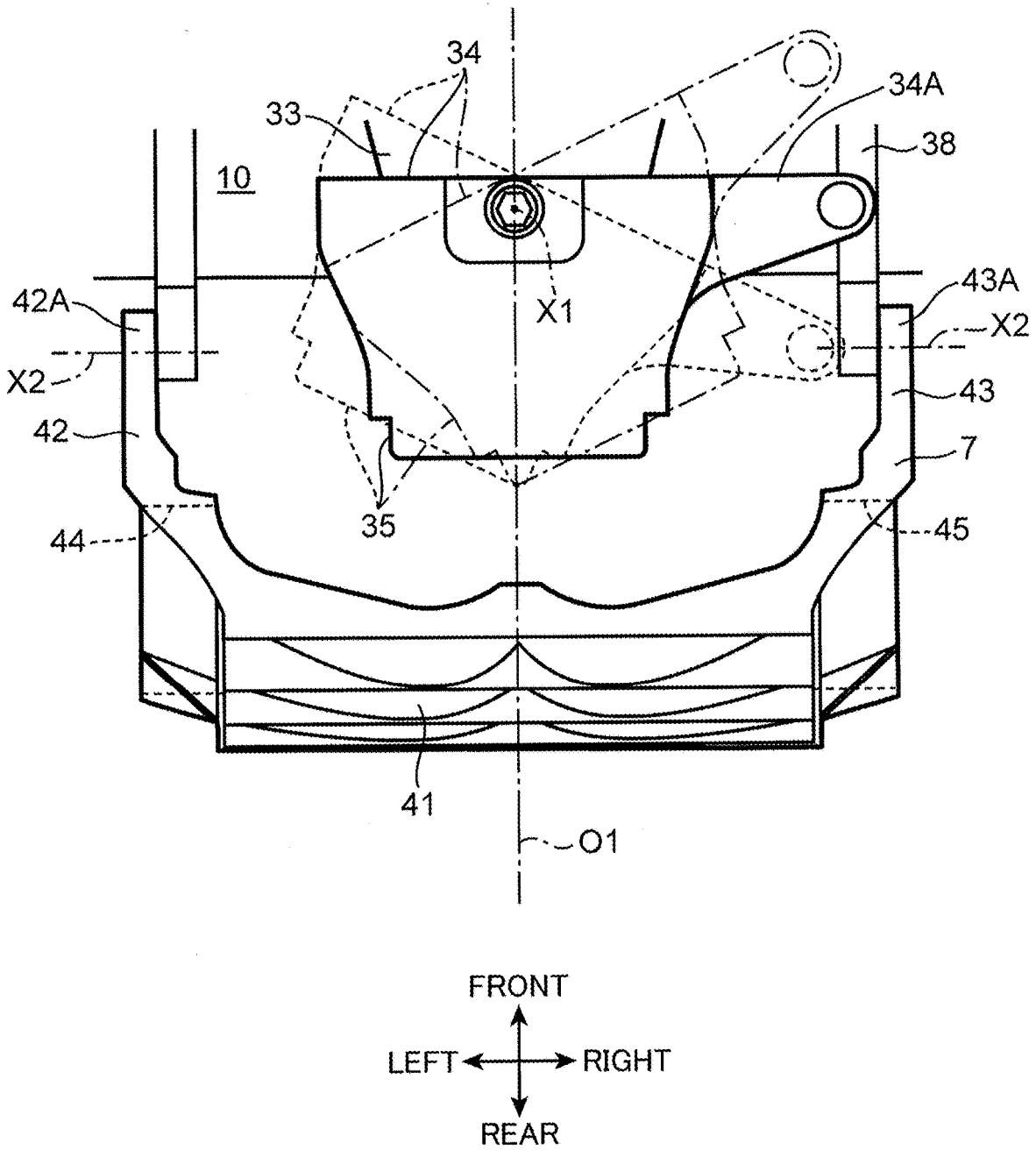
FIG. 4 is a schematic plan view showing the periphery of the jet nozzle.
Figure 5:
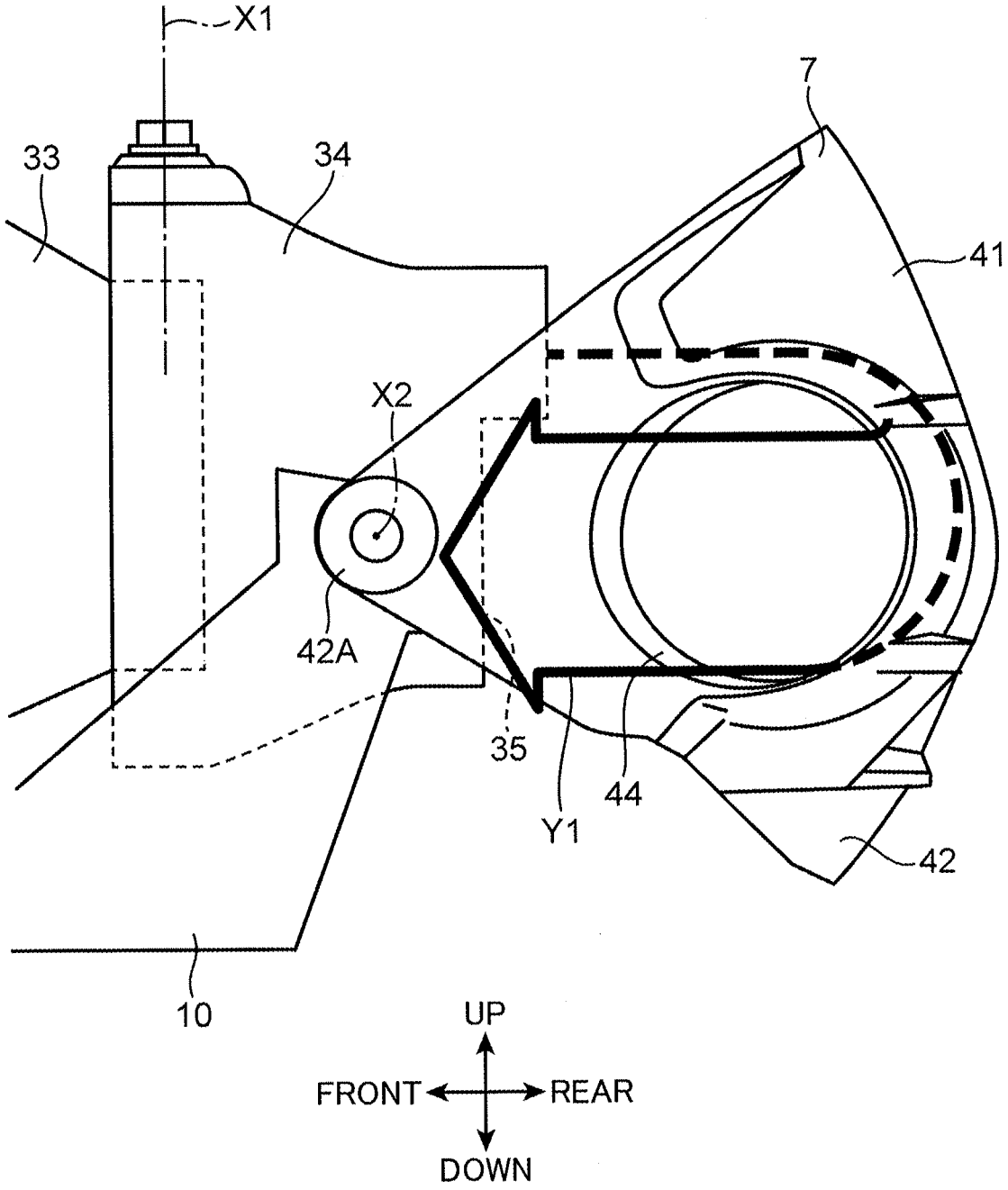
FIG. 5 is a schematic side view showing the periphery of the jet nozzle.

FIG. 3 is a schematic perspective view showing the periphery of the jet nozzle 34. FIG. 4 is a schematic plan view showing the periphery of the jet nozzle 34. FIG. 5 is a schematic side view showing the periphery of the jet nozzle 34. Note that FIG. 3 is a view of a state where the reverse bucket 7 is in a neutral position described later, and FIGS. 4 and 5 are views of a state where the reverse bucket 7 is in a reverse position described later.

The jet nozzle 34 has a substantially cylindrical shape extending in the front-rear direction. The jet nozzle 34 is supported by the Venturi nozzle 33 and thus the boat body 10 so as to be swingable laterally. Specifically, a center part of left and right of a front end part of the jet nozzle 34 is immovably fixed to the Venturi nozzle 33. An outer peripheral surface of the jet nozzle 34 is provided with a flange portion 34A protruding outward. A shaft 38 extending in the front-rear direction is coupled to this flange portion 34A. As the shaft 38 slides and moves in the front-rear direction, as indicated by the broken line, the solid line, and the chain line of FIG. 4, the jet nozzle 34 rotates about a rotation center line X1 passing through the left and right center of a front end part of the jet nozzle 34 and extending in the up-down direction. That is, the jet nozzle 34 swings in the lateral direction. When the jet nozzle 34 swings, the orientation of the jet port 35 and the jet direction of the jet water stream from the jet port 35 are changed to left and right. The jet nozzle 34 is of an electric type and is swung by an electric motor. Specifically, the shaft 38 is slidably driven in the front-rear direction by the electric motor. This electric motor is fed with power from the battery 80.

Hereinafter, the electric motor that swings the jet nozzle 34 is called a nozzle motor 39. Regarding the position of the jet nozzle 34, a position where the center axis of the jet nozzle 34 extends straight in the front-rear direction as indicated by the solid lines in FIGS. 2 and 4 and the jet port 35 opens straight rearward is called a basic position. Regarding the swinging direction of the jet nozzle 34, a case where the jet nozzle 34 swings so that the rear end of the jet nozzle 34 moves to the left as indicated by the solid line to the broken line in FIG. 4 is called swinging leftward, and a case where the jet nozzle 34 swings to the opposite side is called swinging rightward. Note that the jet nozzle 34 shown in FIG. 3 swings leftward from the basic position. The nozzle motor 39 corresponds to the "nozzle drive device" in the present disclosure.

Here, although not shown, the boat body 10 is also provided with a tilt mechanism that pivots the jet nozzle 34 in the up-down direction. At the time of execution of normal navigation control described later or the like, the jet nozzle 34 is appropriately pivoted in the up-down direction by this tilt mechanism.

Figure 6:
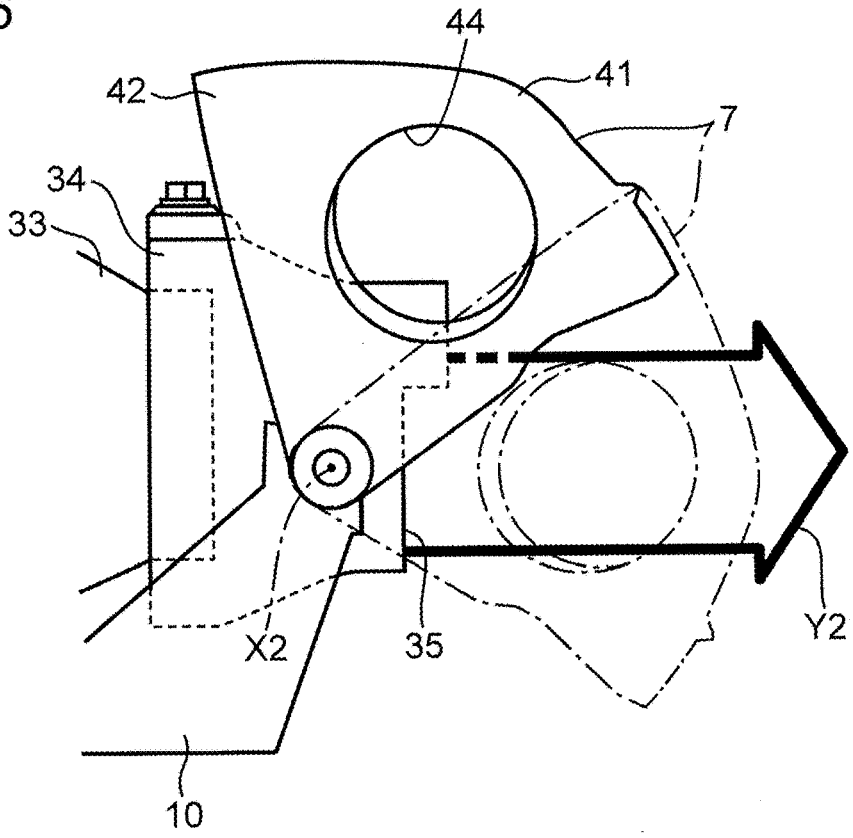
FIG. 6 is a schematic side view showing an operation of a reverse bucket provided in the jet propulsion boat.
Figure 7:
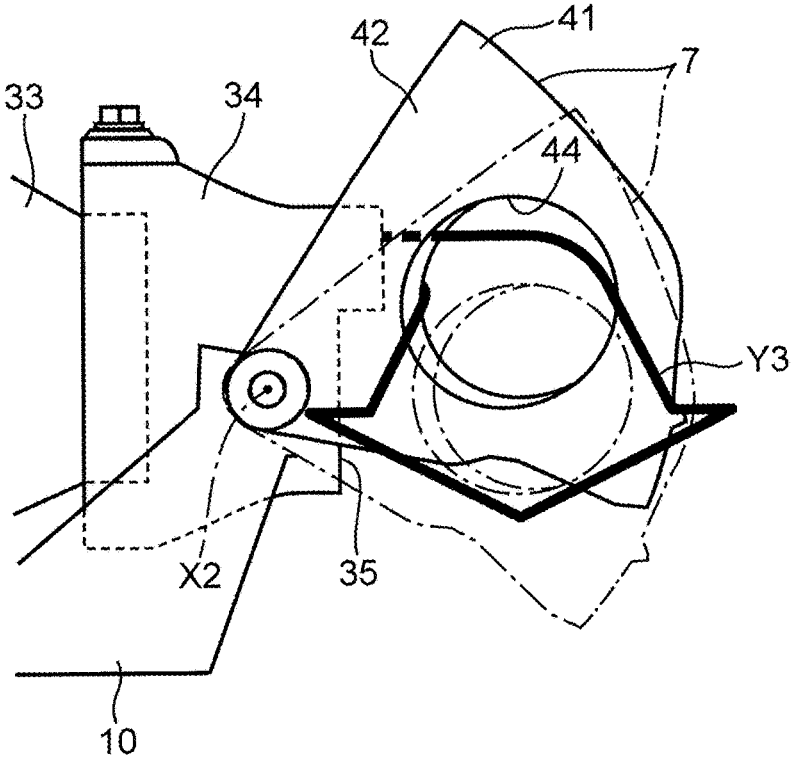
FIG. 7 is a schematic side view showing the operation of the reverse bucket.

FIGS. 6 and 7 are views corresponding to FIG. 5, and are schematic side views showing the operation of the reverse bucket 7. The reverse bucket 7 is a member movable between a reverse position and a forward position. The reverse position is a position where the reverse bucket 7 covers the jet port 35 of the jet nozzle 34 from the rear as indicated by the solid line in FIG. 5 and chain lines in FIGS. 6 and 7. The forward position is a position at which the jet port 35 is exposed as indicated by the solid line in FIG. 6. The position of the reverse bucket 7 is switched among the reverse position, the forward position, and a neutral position. The neutral position is an intermediate position between the forward position and the reverse position as indicated by the solid line in FIG. 7.

The reverse bucket 7 includes a body wall 41 the jet port 35 from the rear in a state of being in the reverse position. The body wall 41 has a shape extending in the lateral direction. In plan view, the lateral center of the body wall 41 is substantially positioned on the center line O1 of the boat body 10. The lateral dimension of the body wall 41 is greater than the lateral dimension of the jet port 35. In side view, in a state where the reverse bucket 7 is in the reverse position, the up-down center of the body wall 41 is at substantially the same height as the center of the jet port 35 in side view. In a state of being in the reverse position, the up-down dimension of the body wall 41 is greater than the up-down dimension of the jet port 35. Due to this, in the state where the reverse bucket 7 is in the reverse position, the jet port 35 is entirely covered by the body wall 41. The body wall 41 has a shape substantially along an arc in a state of being viewed along the lateral direction.

The reverse bucket 7 includes a left wall portion 42 and a right wall portion 43 extending in a direction that is a front side in the state of being at the reverse position, respectively, from the left edge and the right edge of the body wall 41. Through holes 44 and 45 are formed in the left wall portion 42 and the right wall portion 43, respectively.

The front end part of the left wall portion 42 and the front end part of the right wall portion 43 in the reverse position are provided with coupling portions 42A and 43A, respectively. The coupling portions 42A and 43A are coupled to the boat body 10. The reverse bucket 7 is supported by the boat body 10 by these couplings. Each of the coupling portions 42A and 43A is coupled to the boat body 10 rotatably about a rotation center line X2 passing therethrough and extending in the lateral direction. The reverse bucket 7 pivots in the up-down direction about this rotation center line X2. A shaft 48 is coupled to the left wall portion 42. As this shaft 48 slides and moves in the front-rear direction, the reverse bucket 7 pivots in the up-down direction, and the position thereof is switched. The reverse bucket 7 is of an electric type, and the reverse bucket 7 is pivoted by an electric motor. That is, the shaft 48 is driven by the electric motor. Hereinafter, the electric motor that pivots the reverse bucket 7 is called a bucket motor 49. The bucket motor 49 is fed with power from the battery 80.

As described above, the reverse position is a position where the entire jet port 35 is covered from the rear by the reverse bucket 7. In a state where the reverse bucket 7 is in the reverse position, as indicated by arrow Y1 in FIG. 5, the orientation of the jet water stream jetted rearward from the jet port 35 is changed forward by collision with the body wall 41, and the jet water stream is ejected forward from the left and right through holes 44 and 45. Thus, in the state where the reverse bucket 7 is in the reverse position, a rearward propulsion force is imparted to the boat body 10 from the main propulsion device 2. When the auxiliary propulsion device 3 is stopped, this propulsion force causes the boat body 10 to travel rearward.

When the jet nozzle 34 is swung rightward with respect to the basic position in a state where the reverse bucket 7 is in the reverse position and the thruster motor 59 is stopped while the engine 5 is driven, the jet water stream is jetted diagonally right rearward from the jet port 35, and then deflected by the reverse bucket 7 to travel diagonally right forward. Along with this, a propulsion force oriented left rearward is imparted to the boat body 10. Therefore, in this case, the boat body 10 travels diagonally left rearward. When the jet nozzle 34 is swung leftward with respect to the basic position in the above state, the jet water stream is jetted diagonally left rearward from the jet port 35, and then deflected by the reverse bucket 7 to travel diagonally left forward. Along with this, a propulsion force oriented right rearward is imparted to the boat body 10. Therefore, in this case, the boat body 10 travels diagonally right rearward.

As shown in FIG. 6, when the reverse bucket 7 is in the forward position, the body wall 41 is in an attitude extending in the front-rear direction and the lateral direction above the jet nozzle 34. In a state where the reverse bucket 7 is in the forward position, substantially the entire jet port 35 is exposed rearward. In this state, as indicated by arrow Y2 in FIG. 6, the jet water stream jetted from the jet port 35 travels rearward without being deflected. Due to this, in the state where the reverse bucket 7 is in the forward position, a forward propulsion force is imparted to the boat body 10 from the main propulsion device 2. When the auxiliary propulsion device 3 is stopped, this propulsion force causes the boat body 10 to travel forward.

When the jet nozzle 34 is swung rightward with respect to the basic position in a state where the reverse bucket 7 is in the forward position and the engine 5 is driven while the thruster motor 59 is stopped, the jet water stream is jetted diagonally right rearward from the jet port 35. Along with this, a propulsion force oriented left forward is imparted to the boat body 10. Therefore, in this case, the boat body 10 travels diagonally left forward. When the jet nozzle 34 is swung leftward with respect to the basic position in the above state, the jet water stream is jetted diagonally left rearward from the jet port 35. Along with this, a propulsion force oriented diagonally right forward is imparted to the boat body 10. Therefore, in this case, the boat body 10 travels diagonally right forward.

As shown in FIG. 7, the neutral position is a position where the jet port 35 is covered from rear by the body wall 41 similarly to the reverse position. On the other hand, the neutral position is a position more upward than the reverse position. In the present embodiment, the neutral position is a position where the lower end of the body wall 41 and the lower end of the jet port 35 are substantially at the same height. In a state where the reverse bucket 7 is in the neutral position, as indicated by arrow Y3 in FIG. 7, the jet water stream jetted from the jet port 35 is divided left and right, and travels left and right outward through the through holes 44 and 45. Thus, when the reverse bucket 7 is in the neutral position, no propulsion force in the front-rear direction is imparted to the boat body 10 from the main propulsion device 2, and the boat body 10 stops on the spot while jetting a jet water stream.

The reverse position corresponds to the "second position" in the present disclosure, and the forward position corresponds to the "first position" in the present disclosure. The bucket motor 49 that pivots the reverse bucket 7 corresponds to the "bucket position change device" in the present disclosure. A unit 9 including the reverse bucket 7, the bucket motor 49, and the nozzle motor 39 corresponds to the "direction change device" in the present disclosure.

(Operator)

The steering handle 13 is a device for swinging the jet nozzle 34 in the lateral direction to change the traveling direction of the boat body 10. The shift lever 23 is a lever for pivoting the reverse bucket 7 to switch the position among the forward position, the neutral position, and the reverse position. Note that swing of the jet nozzle 34 by the steering handle 13 and pivot of the reverse bucket 7 by the shift lever 23 are possible when a moving mode of the boat body 10 is in execution of normal navigation control described later and the boat body 10 is navigated by the main propulsion device 2 without using the auxiliary propulsion device 3. The accelerator 21 is a device for changing the speed of the boat body 10 when the normal navigation control is executed. The output of the engine 5 is increased or decreased in response to the operation of the accelerator 21. The larger the output of the engine 5 is, the stronger the flow rate, that is, the momentum of the jet water stream, is. The stronger the momentum of the jet water stream is, the greater the propulsion force imparted to the boat body 10 by the jet water stream is.

Figure 8:
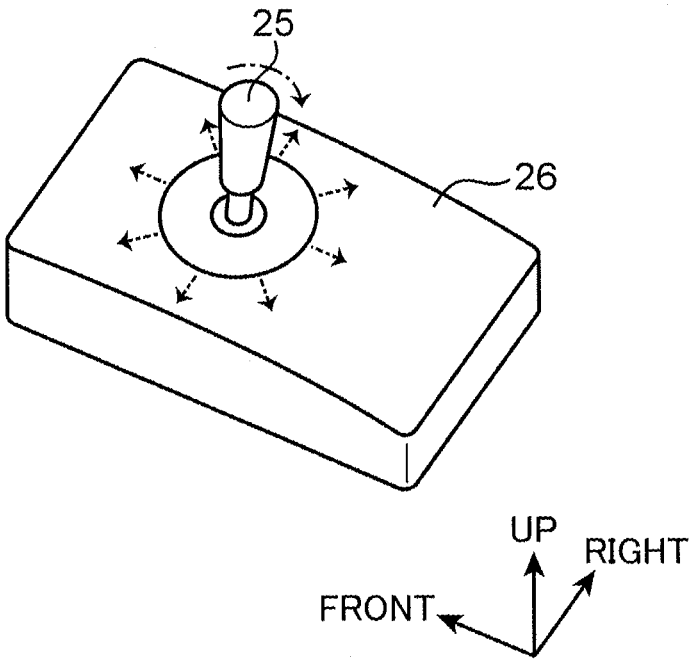
FIG. 8 is a perspective view showing a joystick provided in the jet propulsion boat.

FIG. 8 is a perspective view showing the joystick 25. The joystick 25 is a lever for adjusting the traveling direction and the speed of the boat body 10 when auxiliary navigation control described later is executed. As indicated by the broken line arrow in FIG. 8, the joystick 25 is supported by a base 26 in a state of being tiltable in eight directions of front, rear, left, right, diagonally right front, diagonally right rear, diagonally left front, and diagonally rear left from the neutral position. The joystick 25 has a substantially columnar shape, and is supported by the base 26 such that its center axis extends substantially perpendicular to the base 26 in a state of being in the neutral position. The joystick 25 is pivotally supported by the base 26 about its center axis in a state of being in the neutral position. As indicated by the chain line arrow in FIG. 8, the joystick 25 is pivotally supported in both left and right directions.

(Auxiliary Propulsion Device)

Figure 9:
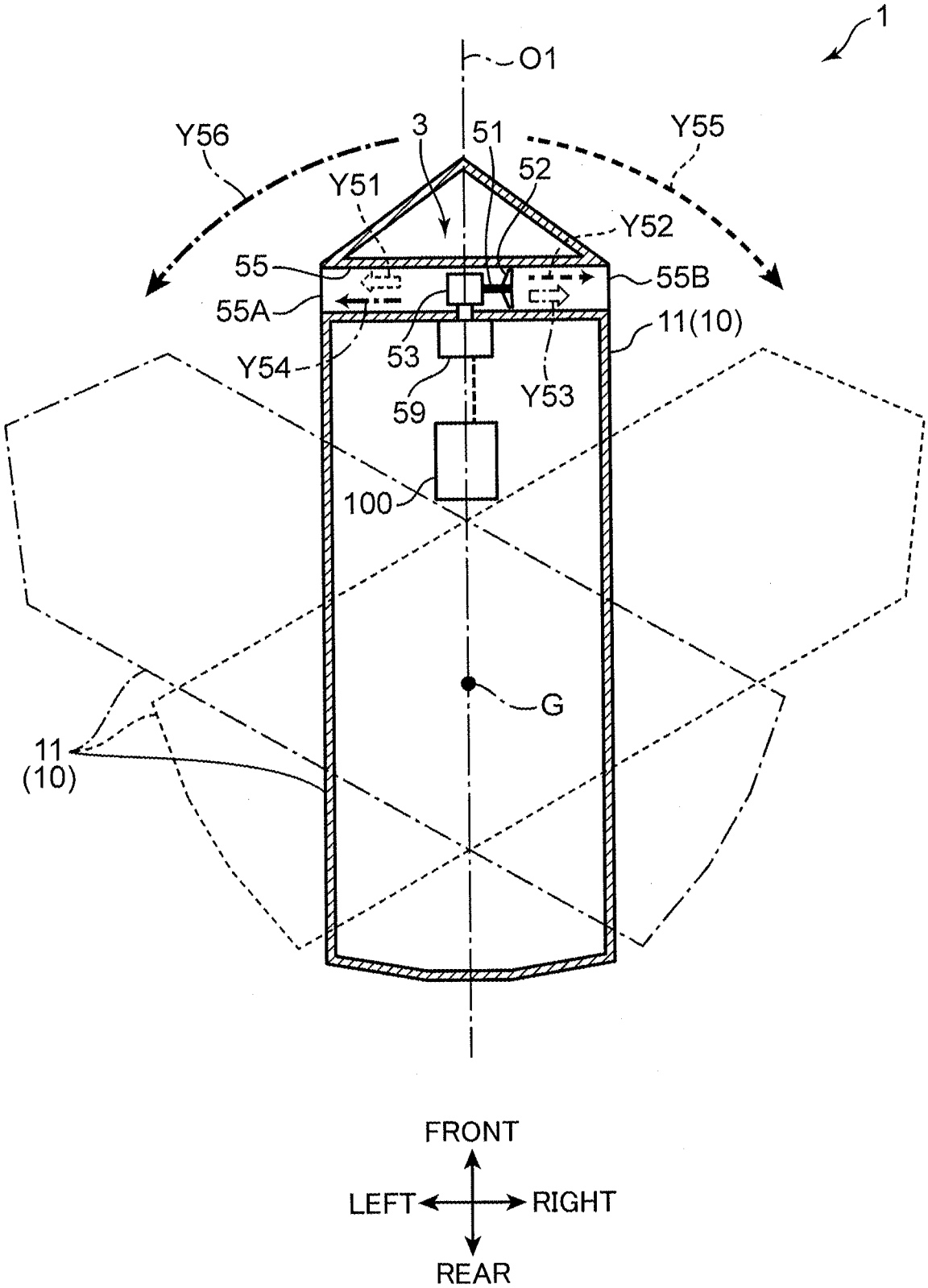
FIG. 9 is a plan cross-sectional view schematically showing a structure of an auxiliary propulsion device of the jet propulsion boat.

FIG. 9 is a plan cross-sectional view schematically showing the structure of the auxiliary propulsion device 3. The auxiliary propulsion device 3 is provided at a front part of the boat body 10. The auxiliary propulsion device 3 is disposed more forward than the seat 14 and the center of gravity G of the PWC 1. The auxiliary propulsion device 3 generates an auxiliary water stream directed outward in the lateral direction from the front part of the boat body 10, that is, directed rightward or leftward. This auxiliary water stream imparts a propulsion force to the boat body 10 in the lateral direction, that is, the width direction of the boat body 10.

The auxiliary propulsion device 3 is a so-called electric thruster. The auxiliary propulsion device 3 includes a propeller shaft 51, an impeller 52, and a gear mechanism 53. As described above, the auxiliary propulsion device 3 includes the thruster motor 59 as a drive source. The thruster motor 59 is fed with power from the battery 80.

The boat body 10 includes a water passage 55 in a position corresponding to the auxiliary propulsion device 3. The water passage 55 is a passage penetrating a front part of the hull 11 in the lateral direction. As shown in FIG. 9, the water passage 55 causes a left opening 55A opening on the left side surface of the front part of the hull 11 and a right opening 55B opening on the right side surface of the front part of the hull 11 to communicate with each other.

The thruster motor 59 is disposed inside the hull 11 more rearward than the water passage 55. The propeller shaft 51, the impeller 52, and the gear mechanism 53 are accommodated inside the water passage 55. The driving force of the thruster motor 59 is transmitted to the impeller 52 via the gear mechanism 53 and the propeller shaft 51 and rotates the impeller 52 about an axis. Specifically, the gear mechanism 53 is a bevel gear mechanism linked with an output shaft of the thruster motor 59. The propeller shaft 51 is a shaft coupling the gear mechanism 53 and the impeller 52. The rotation input from the thruster motor 59 to the gear mechanism 53 is changed in direction by 90 degrees and then transmitted to the impeller 52. Due to this, the impeller 52 rotates about an axis extending in the lateral direction.

The rotation of the impeller 52 causes water introduced into the water passage 55 to be jetted from one end (the left opening 55A or the right opening 55B) of the water passage 55. Due to this, the auxiliary water stream, which is a water stream along the lateral direction, is generated.

The thruster motor 59 can rotate forward and backward. The orientation of the auxiliary water stream is switched by switching the rotation direction of the thruster motor 59. During the forward rotation of the thruster motor 59, a leftward auxiliary water stream is generated as indicated by arrow Y51 in FIG. 9. The leftward auxiliary water stream imparts a rightward propulsion force to the boat body 10 as indicated by arrow Y52. During the backward rotation of the thruster motor 59, a rightward auxiliary water stream is generated as indicated by arrow Y53 in FIG. 9. The rightward auxiliary water stream imparts a leftward propulsion force to the boat body 10 as indicated by arrow Y54.

The auxiliary water stream is generated more forward than the center of gravity G of the PWC 1. Due to this, when the auxiliary water stream is generated, the boat body 10 is applied with a yaw moment. When a leftward auxiliary water stream (Y51) is generated, a rightward propulsion force (Y52) is imparted to the front part of the boat body 10, whereby the boat body 10 is applied with a clockwise yaw moment as indicated by arrow Y55. Therefore, when the engine 5 is stopped and a leftward auxiliary water stream is generated by the auxiliary propulsion device 3, the boat body 10 does not substantially move in the front-rear direction and turns clockwise as indicated by the solid line to the broken line in FIG. 9. On the contrary, when a rightward auxiliary water stream (Y53) is generated, the boat body 10, the boat body 10 is applied with a counterclockwise yaw moment as indicated by arrow Y56. Therefore, when the engine 5 is stopped and a rightward auxiliary water stream is generated by the auxiliary propulsion device 3, the boat body 10 does not substantially move in the front-rear direction and turns counterclockwise as indicated by the solid line to the chain line in FIG. 9. This, the auxiliary propulsion device 3 is provided at a position shifted in the front-rear direction from the center of gravity G of the PWC 1, the position where the boat body 10 turns when the thruster motor 59 is driven in a state where the engine 5 is stopped.

The larger the output of the thruster motor 59 is, the stronger the flow rate, that is, the momentum of the auxiliary water stream is. The stronger the momentum of the auxiliary water stream is, the greater the propulsion force imparted to the boat body 10 by the auxiliary water stream is.

[Sliding and Moving]

When the thruster motor 59 is stopped to drive the engine 5, the reverse bucket 7 is in the forward position, and the jet nozzle 34 is in the basic position, the boat body 10 travels forward while maintaining its attitude, that is, while maintaining the orientation of the bow. In a case where only the engine 5 is driven, when the reverse bucket 7 is in the reverse position and the jet nozzle 34 is in the basic position, the boat body 10 travels rearward while maintaining the orientation of the bow.

However, in a case where only the engine 5 is driven, it is impossible to travel the boat body 10 in a direction deviated from the front-rear direction while maintaining the orientation of the bow.

Specifically, in a state where the thruster motor 59 is stopped to drive the engine 5 and the reverse bucket 7 is in the forward position or the reverse position, if the jet nozzle 34 is pivoted in the lateral direction from the basic position, the boat body 10 travels in a direction deviated from the front-rear direction. However, in this case, the propulsion force imparted to the rear end part of the boat body 10 by the main propulsion device 2 includes a lateral component. Therefore, in this case, the boat body 10 is applied with one of right and left yaw moments. As a result, the boat body 10 travels along with a change in the orientation of the bow in the lateral direction.

On the other hand, by driving both the engine 5 and the thruster motor 59 and adjusting the direction and magnitude of these propulsion forces, the boat body 10 can travel in a direction deviated from the front-rear direction while maintaining the orientation of the bow.

In the PWC 1, eight patterns are set as slide patterns that are control patterns for moving the boat body 10 while maintaining the orientation of the bow. Two patterns of them are a front slide pattern for moving the boat body 10 straight forward and a rear slide pattern for moving the boat body 10 straight rearward, which are implemented by drive of only the engine 5. The remaining six patterns are special slide patterns for moving the boat body 10 in six directions deviated from the front-rear direction, which are implemented by drive of both the engine 5 and the thruster motor 59.

The special slide pattern includes a right front slide pattern for moving the boat body 10 at an angle of 45 degrees to the right forward, a right slide pattern for moving the boat body 10 rightward, and a right rear slide pattern for moving the boat body 10 at an angle of 45 degrees to the right rearward. The special slide pattern includes a left front slide pattern for moving the boat body 10 at an angle of 45 degrees to the left forward, a left slide pattern for moving the boat body 10 leftward, and a left rear slide pattern for moving the boat body 10 at an angle of 45 degrees to the left rearward.

FIG. 10 is a tabular view showing a control aspect of each device and a traveling direction of the boat body 10 in a slide pattern. Note that although FIG. 10 does not show a drive state of the engine 5, the engine 5 is driven in any of the eight slide patterns. In the column of the traveling direction in FIG. 10, the solid arrow indicates the traveling direction of the boat body 10, and the broken arrow indicates the water stream. Hereinafter, as appropriate, eight directions corresponding to the eight slide patterns, that is, forward, rearward, rightward, leftward, 45 degrees to the right forward, 45 degrees to the right rearward, 45 degrees to the left forward, and 45 degrees to the left rearward are collectively called eight slide directions. Hereinafter, the traveling direction shown in the table of FIG. 10 and implemented in a calm and still water state is appropriately called a basic slide direction.

(Front Slide Pattern)

As described above, in the front slide pattern, the engine 5 is driven while the thruster motor 59 is stopped. The position of the jet nozzle 34 is in the basic position, and the position of the reverse bucket 7 is in the forward position (F). Due to this, the boat body 10 moves straight forward while maintaining the orientation of the bow at least in a calm and still water state.

(Rear Slide Pattern)

As described above, in the rear slide pattern, the engine 5 is driven while the thruster motor 59 is stopped. The position of the jet nozzle 34 is in the basic position, and the position of the reverse bucket 7 is in the reverse position (R). Due to this, the boat body 10 moves straight rearward while maintaining the orientation of the bow at least in a calm and still water state.

(Right Front Slide Pattern)

Figure 11:
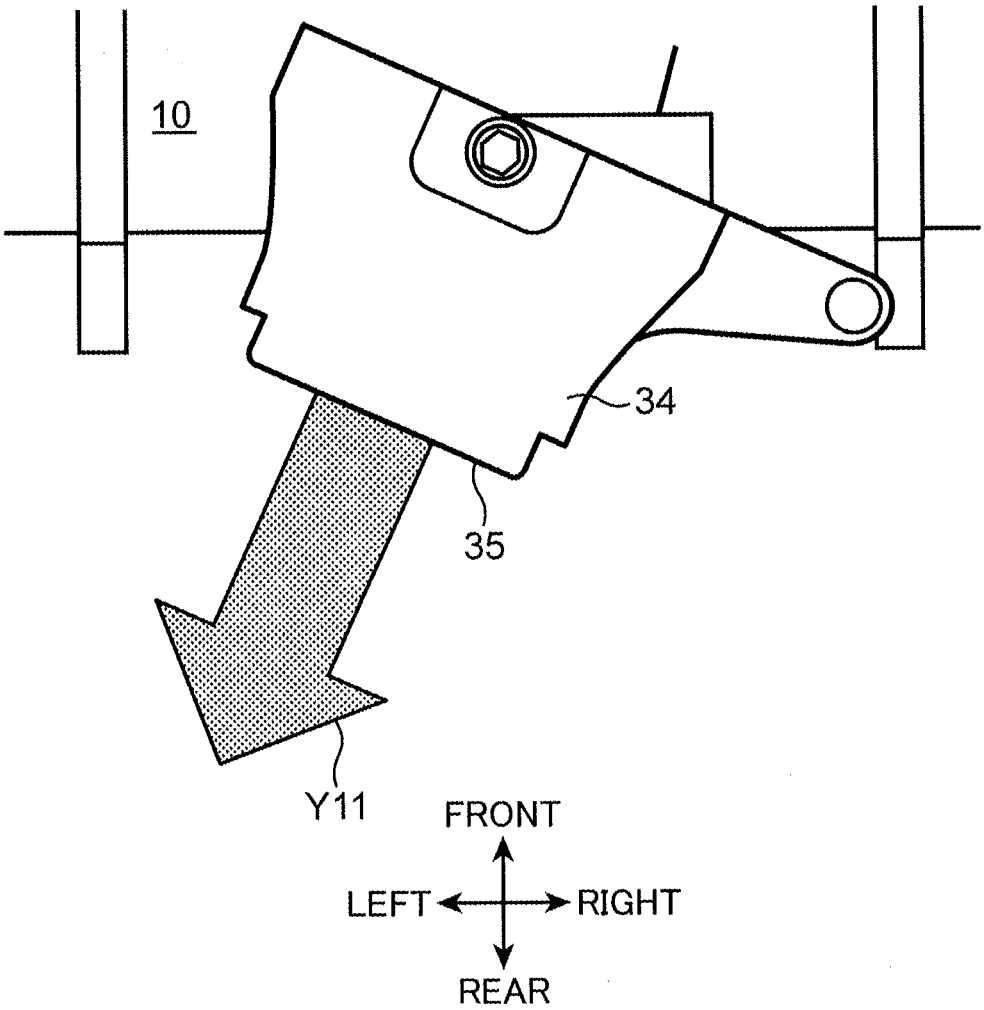
FIG. 11 is a plan view schematically showing a jet water stream in a right front slide pattern.
Figure 12:
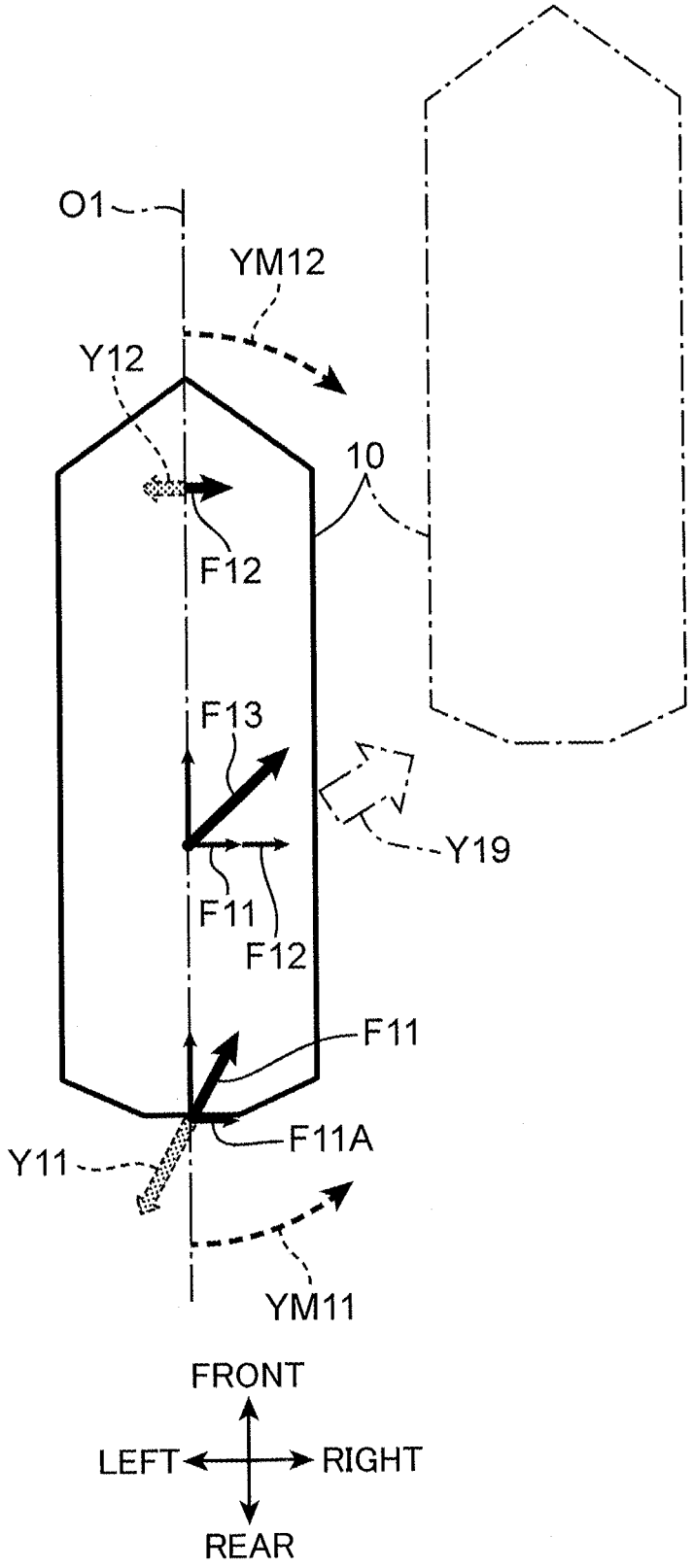
FIG. 12 is a plan view schematically showing a propulsion force and the like acting on the boat body in the right front slide pattern.

FIG. 11 is a plan view schematically showing a jet water stream in a right front slide pattern. FIG. 12 is a plan view schematically showing a propulsion force and the like imparted to the boat body 10 in the right front slide pattern.

In the right front slide pattern, the position of the jet nozzle 34 is a first position pivoted leftward from the basic position. In the right front slide pattern, the position of the reverse bucket 7 is the forward position (F). Due to this, as indicated by arrow Y11 in FIGS. 11 and 12, the jet water stream is ejected diagonally left rearward from the jet port 35. As shown in FIG. 12, this jet water stream imparts a propulsion force F11 diagonally right forward to the rear end part of the boat body 10. This propulsion force F11 includes a rightward component F11A. Therefore, a counterclockwise yaw moment YM11 is imparted to the boat body 10 by the jet water stream.

In the right front slide pattern, the thruster motor 59 is rotated forward. Due to this, a leftward auxiliary water stream is generated as indicated by arrow Y12 in FIG. 12. This auxiliary water stream imparts a rightward propulsion force F12 to the front part of the boat body 10. By this propulsion force F12, a clockwise yaw moment YM12, that is, a yaw moment YM12 in a direction opposite to the counterclockwise yaw moment YM11 caused by the jet water stream is imparted to the boat body 10.

In the right front slide pattern, the flow rates of the jet water stream and the auxiliary water stream are set such that the counterclockwise yaw moment YM11 caused by the jet water stream and the clockwise yaw moment YM12 caused by the auxiliary water stream have the same magnitude and these yaw moments cancel out each other. Specifically, the output of the engine 5 and the output of the thruster motor 59 are set such that the yaw moments YM11 and Y12 cancel out each other. This suppresses yawing of the boat body 10 in the right front slide pattern.

A diagonally right forward force that is a resultant force F13 of the propulsion force F11 imparted by the jet water stream and the propulsion force F12 imparted by the auxiliary water stream acts on the boat body 10. Due to this, the boat body 10 travels diagonally right forward as indicated by arrow Y19 in FIG. 12 in the state where the yawing is suppressed.

Here, the traveling direction of the boat body 10 is determined by the orientation of the jet water stream, that is, the position of the jet nozzle 34. The first position is set in an attitude in which the boat body 10 moves diagonally right forward along a line tilted 45 degrees rightward with respect to the center line O1 of the boat body 10 in a calm and still water state. By this, when a movement pattern of the boat body 10 is the right front slide pattern, the boat body 10 travels at 45 degrees to the right forward in a state where the orientation of the bow is maintained at least in a calm and still water state.

(Right Slide Pattern)

Figure 13:
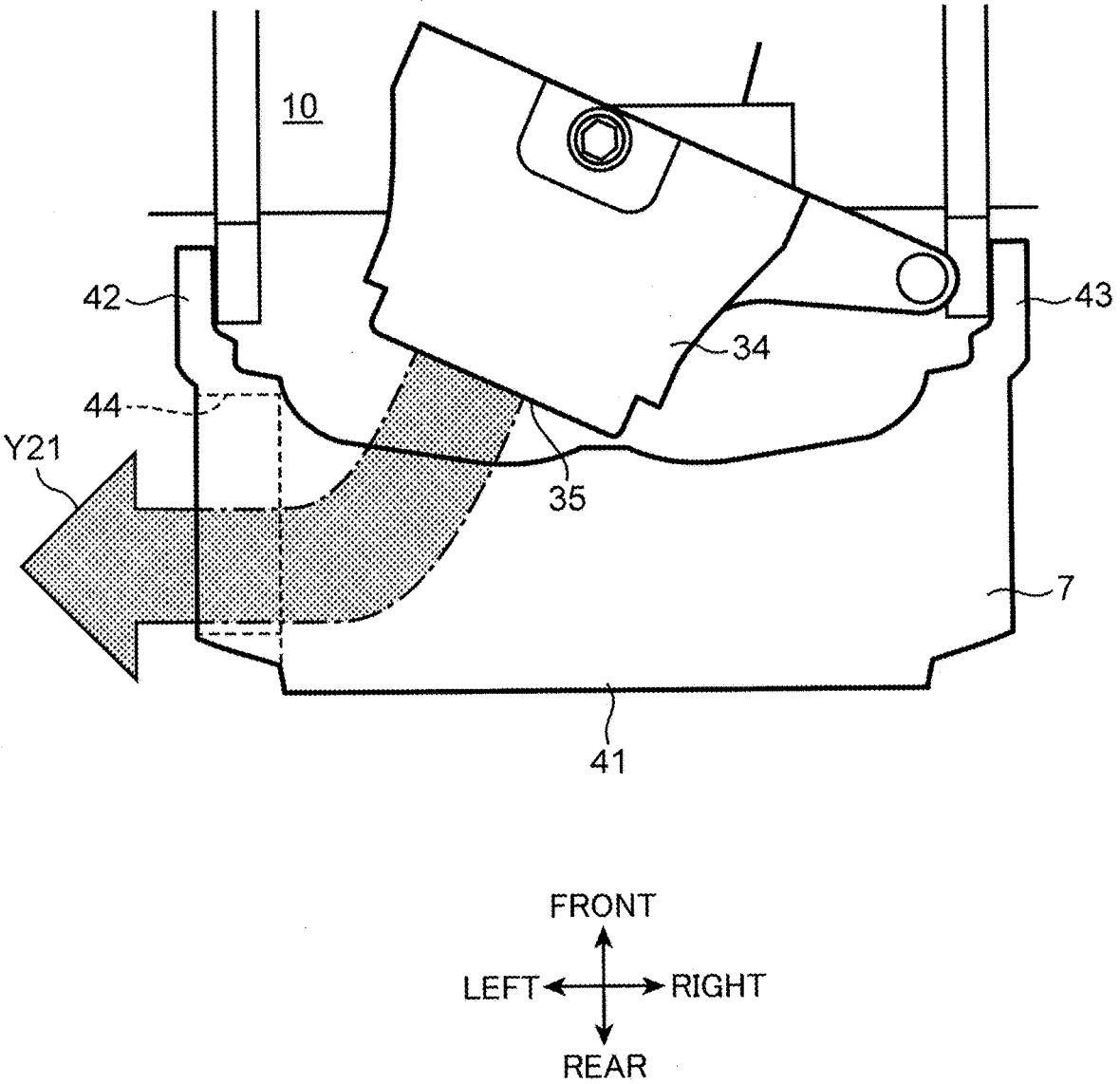
FIG. 13 is a plan view schematically showing a jet water stream in a right slide pattern.
Figure 14:
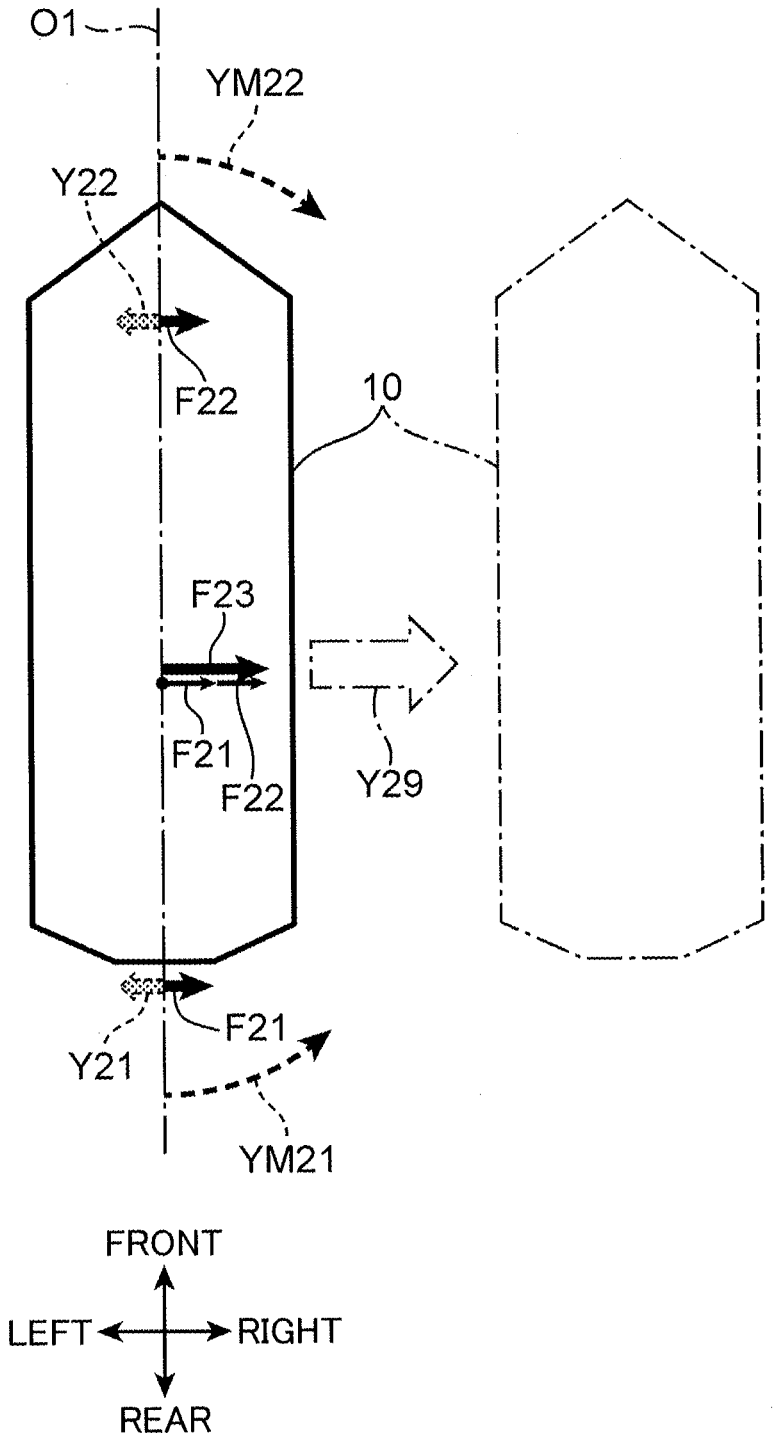
FIG. 14 is a plan view schematically showing a propulsion force and the like acting on the boat body in the right slide pattern.

FIG. 13 is a plan view schematically showing a jet water stream in a right slide pattern. FIG. 14 is a plan view schematically showing a propulsion force and the like imparted to the boat body 10 in the right slide pattern.

In the right slide pattern, the position of the jet nozzle 34 is the first position. In the right slide pattern, the position of the reverse bucket 7 is a neutral position (N). Due to this, as indicated by arrow Y21 in FIG. 13, the jet water stream is ejected diagonally left rearward from the jet port 35, and then ejected leftward through the through hole 44 of the left wall portion 42. That is, in the rightward slide pattern, as indicated by arrow Y21 in FIG. 14, the jet water stream is ejected leftward from the rear end part of the boat body 10. Note that a part of the jet water stream flows out to the outside of the reverse bucket 7 through the through hole 45 of the right wall portion 42, but the amount thereof is small. That is, as described above, the main jet water stream is ejected diagonally left through the through hole 44 of the left wall portion 42. As shown in FIG. 14, this jet water stream imparts a rightward propulsion force F21 to the rear end part of the boat body 10. This jet water stream imparts a counterclockwise yaw moment YM21 to the boat body 10.

In the right slide pattern, the thruster motor 59 is rotated forward. Due to this, a leftward auxiliary water stream is generated as indicated by arrow Y22 in FIG. 14. This auxiliary water stream imparts a rightward propulsion force F22 to the front part of the boat body 10. By this propulsion force F22, a clockwise yaw moment YM22, that is, a yaw moment YM22 in a direction opposite to the counterclockwise yaw moment YM21 caused by the jet water stream is imparted to the boat body 10.

In the right slide pattern, the flow rates of the jet water stream and the auxiliary water stream are set such that the counterclockwise yaw moment YM21 caused by the jet water stream and the clockwise yaw moment YM22 caused by the auxiliary water stream have the same magnitude and these yaw moments cancel out each other. Specifically, the output of the engine 5 and the output of the thruster motor 59 are set such that the yaw moments YM21 and Y22 cancel out each other. This suppresses yawing of the boat body 10 in the right slide pattern.

A rightward force that is a resultant force F23 of the propulsion force F21 imparted by the jet water stream and the propulsion force F22 imparted by the auxiliary water stream acts on the boat body 10. Due to this, the boat body 10 travels rightward in the state where the yawing is suppressed as indicated by arrow Y29 in FIG. 14. That is, the boat body 10 travels rightward in a state where the orientation of the bow is maintained constant at least at the time of calm and still water.

(Right Rear Slide Pattern)

Figure 15:
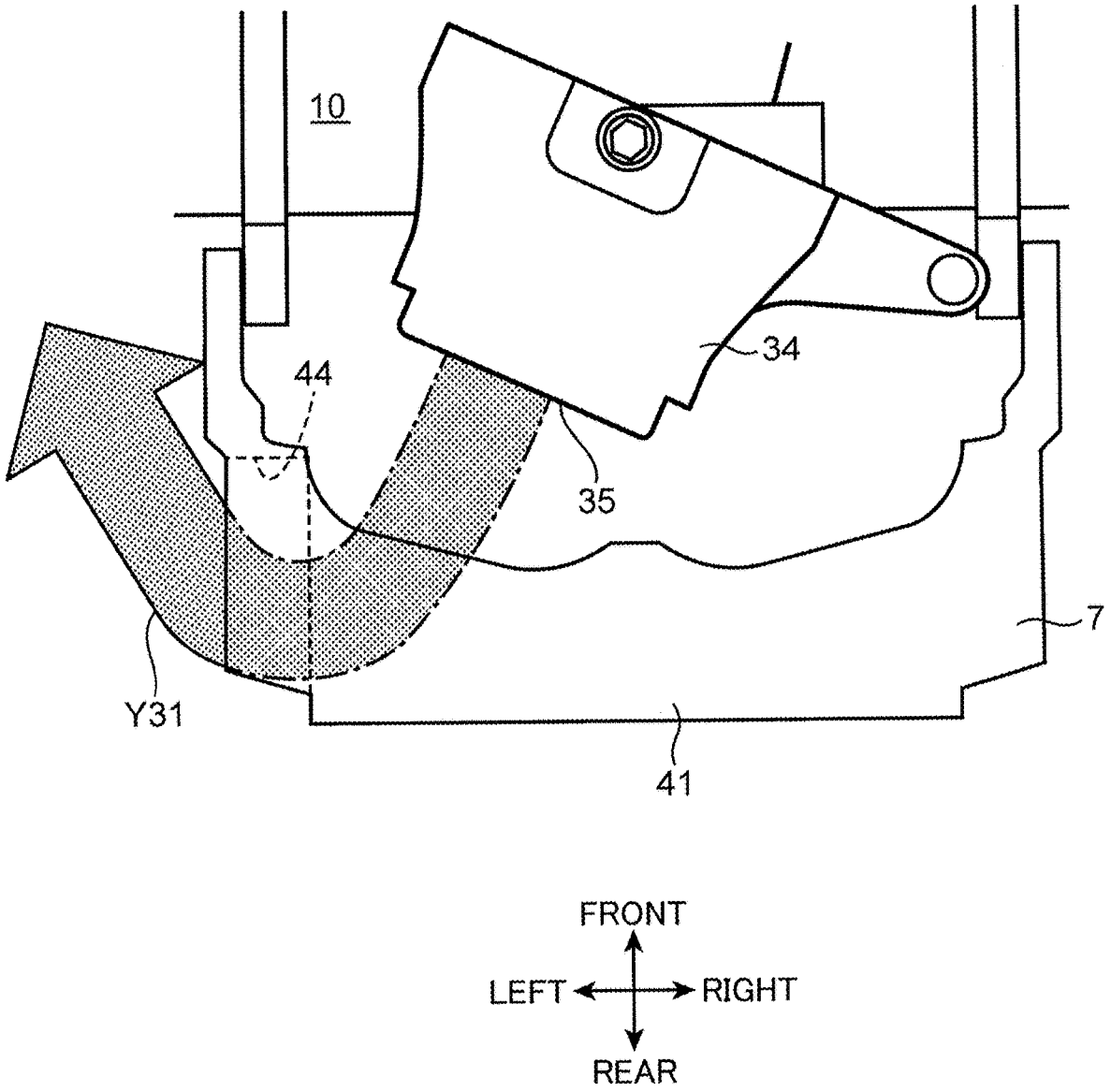
FIG. 15 is a plan view schematically showing a jet water stream in a right rear slide pattern.
Figure 16:
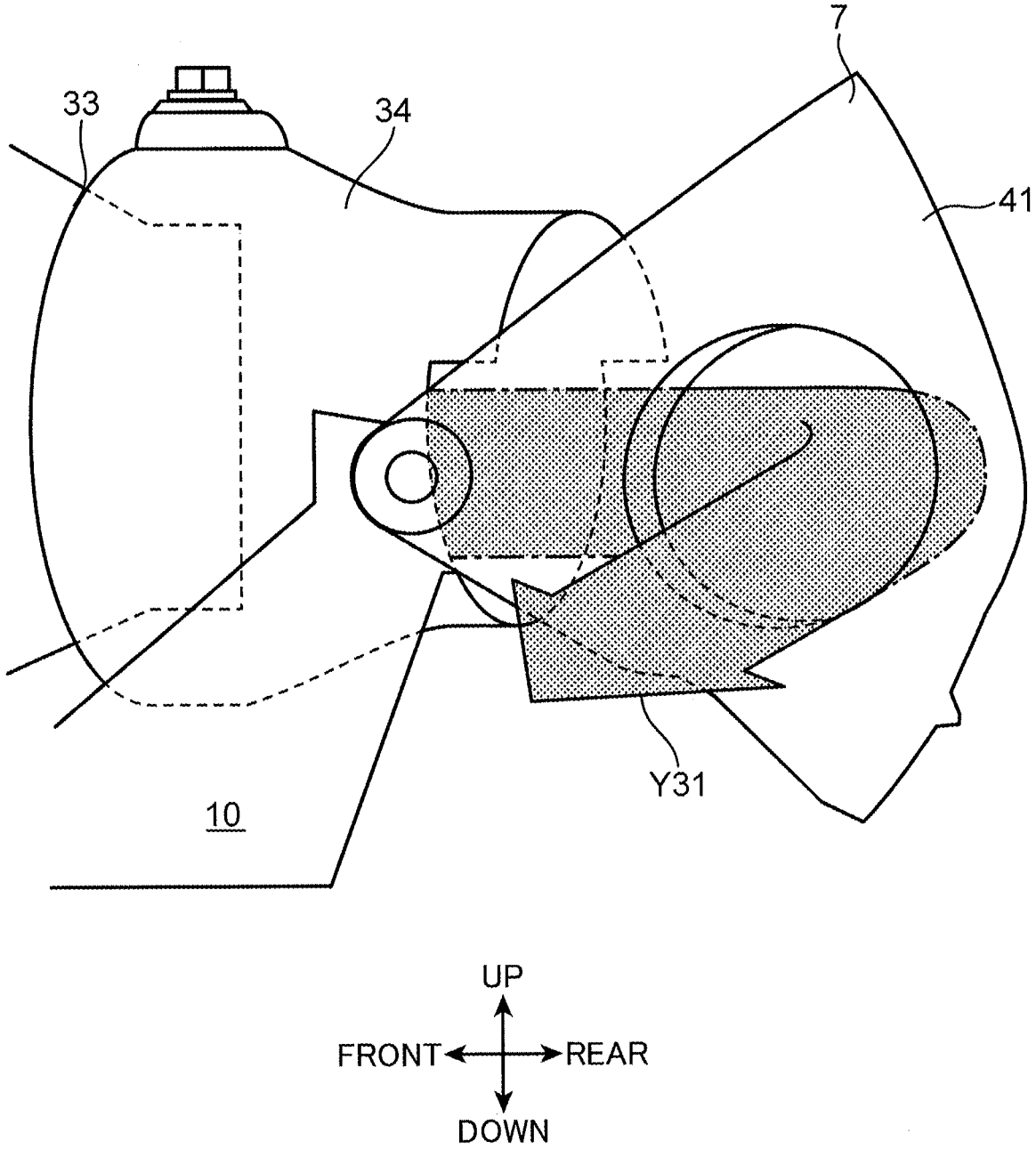
FIG. 16 is a side view schematically showing a jet water stream in the right rear slide pattern.
Figure 17:
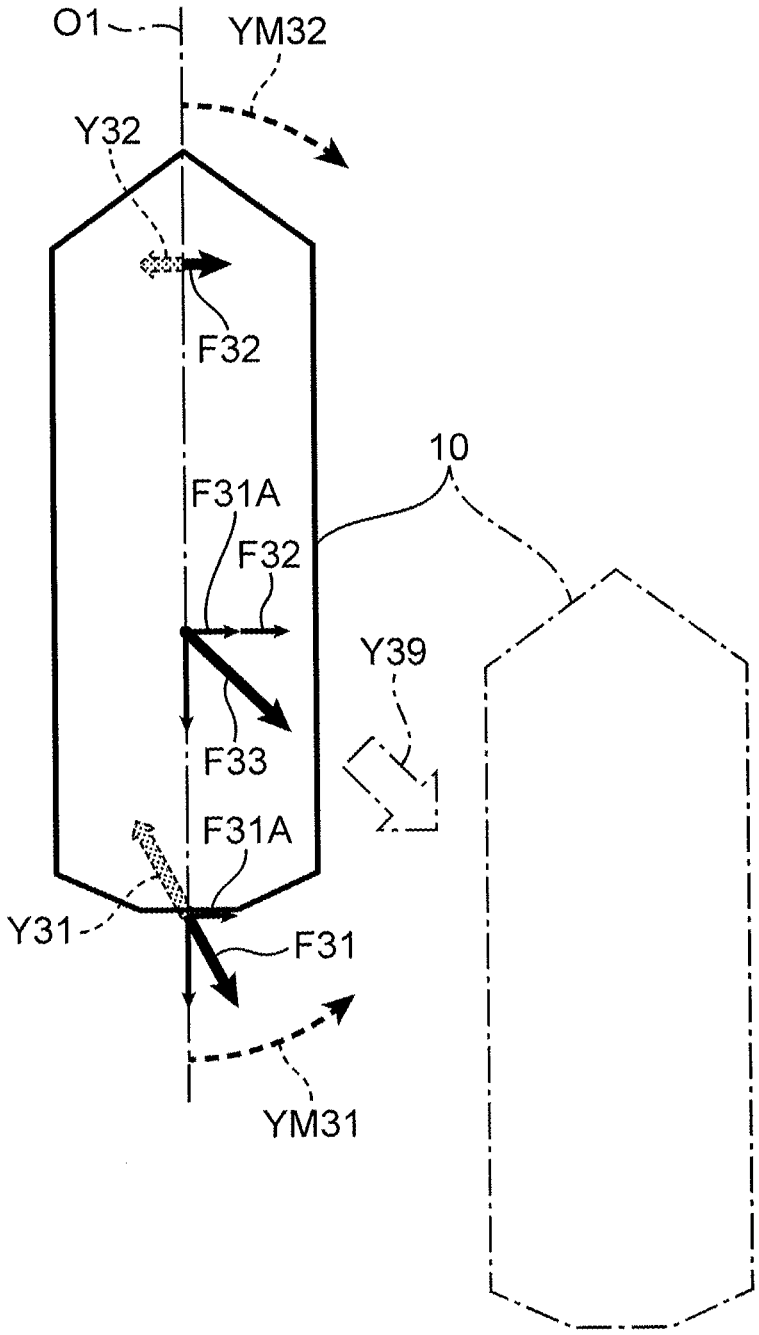
FIG. 17 is a plan view schematically showing a propulsion force and the like acting on the boat body in the right rear slide pattern.

FIGS. 15 and 16 are a plan view and a side view, respectively, schematically showing a jet water stream in a right rear slide pattern. FIG. 17 is a plan view schematically showing a propulsion force and the like imparted to the boat body 10 in the right rear slide pattern.

In the right rear slide pattern, the position of the jet nozzle 34 is the first position. In the right rear slide pattern, the position of the reverse bucket 7 is the reverse position (R). Due to this, as indicated by arrow Y31 in FIGS. 15 and 16, the jet water stream is ejected diagonally left rearward from the jet port 35. This jet water stream is deflected diagonally left forward by the body wall 41 of the reverse bucket 7, and then is oriented diagonally left forward through the through hole 44 of the left wall portion 42. That is, as indicated by arrow Y31 in FIG. 17, in the right rear slide pattern, the jet water stream is ejected diagonally left forward from the vicinity of the rear end part of the boat body 10. As shown in FIG. 17, this jet water stream imparts a diagonally right rearward propulsion force F31 to the rear end part of the boat body 10. This propulsion force F31 includes a rightward component F31A. Therefore, a counterclockwise yaw moment YM31 is imparted to the boat body 10 by the jet water stream. Note that a part of the jet water stream flows out to the outside of the reverse bucket 7 through the through hole 45 of the right wall portion 42, but the amount thereof is small. That is, as described above, the main jet water stream is ejected diagonally left forward through the through hole 44 of the left wall portion 42.

In the right rear slide pattern, the thruster motor 59 is rotated forward. Due to this, a leftward auxiliary water stream is generated as indicated by arrow Y32 in FIG. 17. This auxiliary water stream imparts a rightward propulsion force F32 to the front part of the boat body 10. By this propulsion force F32, a clockwise yaw moment YM32, that is, a yaw moment YM32 in a direction opposite to the counterclockwise yaw moment YM31 caused by the jet water stream is imparted to the boat body 10.

In the right rear slide pattern, the flow rates of the jet water stream and the auxiliary water stream are set such that the counterclockwise yaw moment YM31 caused by the jet water stream and the clockwise yaw moment YM32 caused by the auxiliary water stream have the same magnitude and these yaw moments cancel out each other. Specifically, the output of the engine 5 and the output of the thruster motor 59 are set such that the yaw moments YM31 and Y32 cancel out each other. This suppresses yawing of the boat body 10 in the right rear slide pattern.

A diagonally right forward force that is a resultant force F33 of the propulsion force F31 imparted by the jet water stream and the propulsion force F32 imparted by the auxiliary water stream acts on the boat body 10. Due to this, the boat body 10 travels diagonally right rearward as indicated by arrow Y39 in FIG. 17 in the state where the yawing is suppressed.

Here, in the state where the jet nozzle 34 is in the first position, the orientation of the jet water stream when the reverse bucket 7 is in the forward position and the orientation of the jet water stream when the reverse bucket 7 is in the reverse position are substantially symmetrical with respect to the front-rear direction. By this, when a movement pattern of the boat body 10 is the right rear slide pattern, the boat body 10 travels at 45 degrees to the right rearward in a state where the orientation of the bow is maintained at least in a calm and still water state. That is, the first position related to the jet nozzle 34 is set to a position in which the boat body 10 moves diagonally right forward along a line tilted 45 degrees rightward with respect to the center line O1 of the boat body 10 in a calm and still water state when the reverse bucket 7 is in the forward position, and a position in which the boat body 10 moves diagonally right rearward along a line tilted 45 degrees leftward with respect to the center line O1 of the boat body 10 in a calm and still water state when the reverse bucket 7 is in the reverse position.

(Left Front Slide Pattern, Left Slide Pattern, and Left Rear Slide Pattern)

In each of the left front slide pattern, the left slide pattern, and the left rear slide pattern, the position of the jet nozzle 34 is a second position, which is bilaterally symmetrical with the first position about the center line O1 of the boat body 10. Note that the second position is a position where the jet nozzle 34 is pivoted rightward from the basic position. The position of the reverse bucket 7 in the left front slide pattern is the same forward position (F) as the position in the right front slide pattern. The position of the reverse bucket 7 in the left slide pattern is the same neutral position (N) as the position in the right slide pattern. The position of the reverse bucket 7 in the left rear slide pattern is the same reverse position (R) as the position in the right rear slide pattern.

In the left front slide pattern, the left slide pattern, and the left rear slide pattern, the thruster motor 59 is rotated backward.

According to the above control, the orientations of the propulsion force and the yaw moment acting on the boat body 10 in the left front slide pattern, the left slide pattern, and the left rear slide pattern are bilaterally symmetrical with the orientations of the propulsion force and the yaw moment acting on the boat body 10 in the right front slide pattern, the right slide pattern, and the right rear slide pattern, respectively. Also in the left front slide pattern, the left slide pattern, and the left rear slide pattern, similarly to the slide pattern in the right direction, the flow rates of the jet water stream and the auxiliary water stream are set such that the yaw moment caused by the jet water stream and the yaw moment caused by the auxiliary water stream cancel out each other. Therefore, in the left front slide pattern, at least in a calm and still water state, the boat body 10 moves in a bilaterally symmetrical direction with respect to the right front slide pattern about the center line O1 of the boat body 10, that is, at 45 degrees to the left forward while maintaining the orientation of the bow. In the left rear slide pattern, at least in a calm and still water state, the boat body 10 travels in a direction bilaterally symmetrical to the right rear slide pattern with the center line O1 of the boat body 10 as a symmetry axis, that is, at 45 degrees to the left rearward while maintaining the orientation of the bow. In the left slide pattern, at least in a calm and still water state, the boat body 10 moves leftward while maintaining the orientation of the bow.

[Control System]

Figure 18:
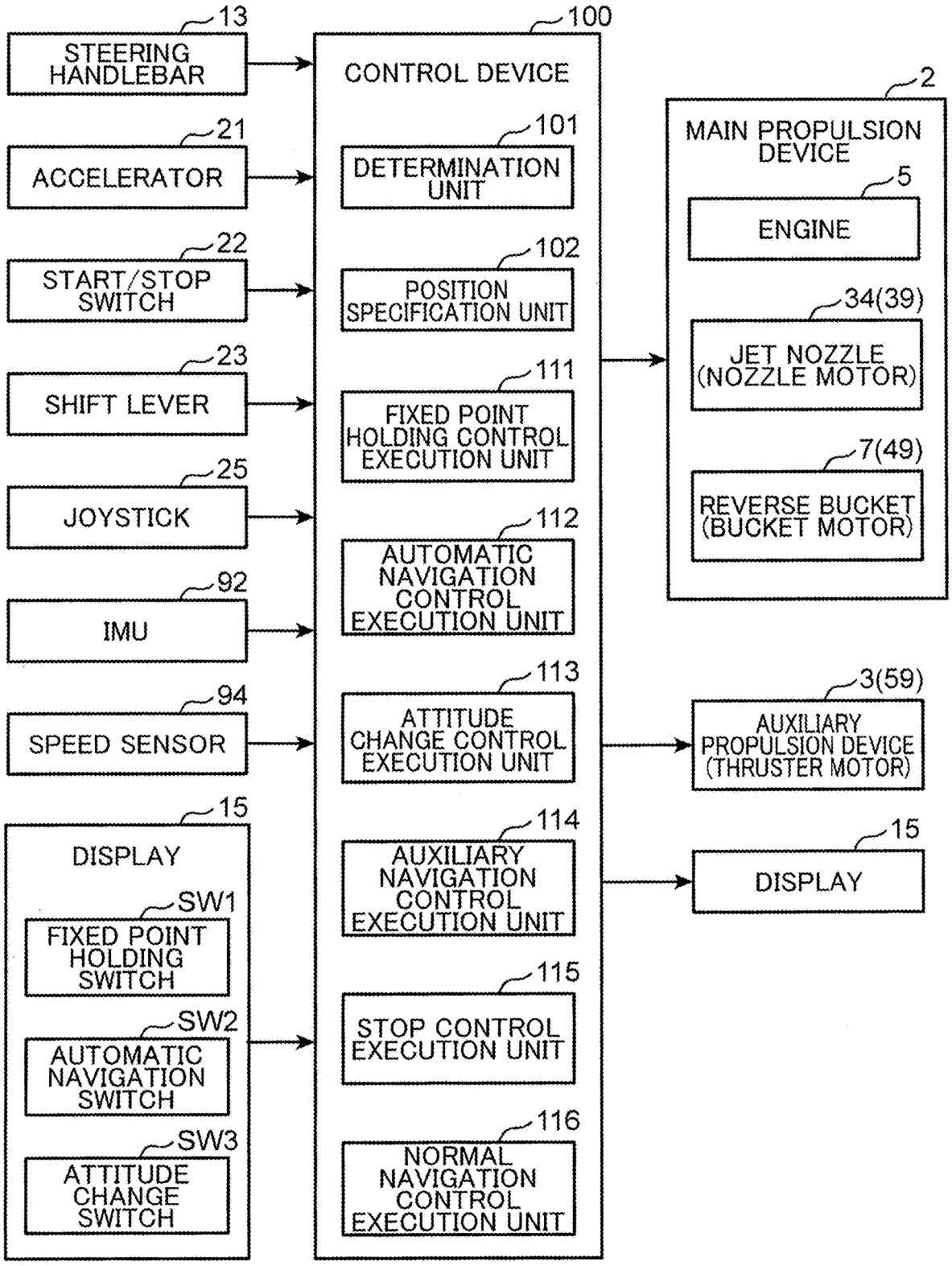
FIG. 18 is a functional block diagram showing a control system of the jet propulsion boat.

A control system of the PWC 1 will be described. The boat body 10 is mounted with a control device 100 for controlling various devices mounted on the boat body 10. FIG. 18 is a functional block diagram showing the control system of the PWC 1. The control device 100 is a device including, as a main part, a microcomputer including a processor (CPU) that performs calculation and memories such as a ROM and a RAM.

The control device 100 is electrically connected to the steering handle 13, the accelerator 21, the start/stop switch 22, the shift lever 23, and the joystick 25, and receives signals from them. Specifically, the steering handle 13, the accelerator 21, the shift lever 23, and the joystick 25 incorporate sensors that detect the operation states, respectively, and the control device 100 receives signals from these sensors.

The boat body 10 is mounted with an IMU (inertial measurement unit) 92 and a speed sensor 94. The control device 100 is electrically connected to the IMU 92 and the speed sensor 94, and receives signals output from them.

The IMU 92 is an inertial measurement unit in which a three-axis gyro sensor and a three-axis acceleration sensor are combined. The IMU 92 detects angular velocities around three axes orthogonal to one another and accelerations in three-axis directions in the boat body 10. The IMU 92 can calculate a bow azimuth of the boat body 10 based on an angular velocity or the like, and also functions as a device that detects the bow azimuth of the boat body 10. The speed sensor 94 detects a navigation speed of the boat body 10. The IMU 92 corresponds to the "bow direction detection device" in the present disclosure.

Figure 19:
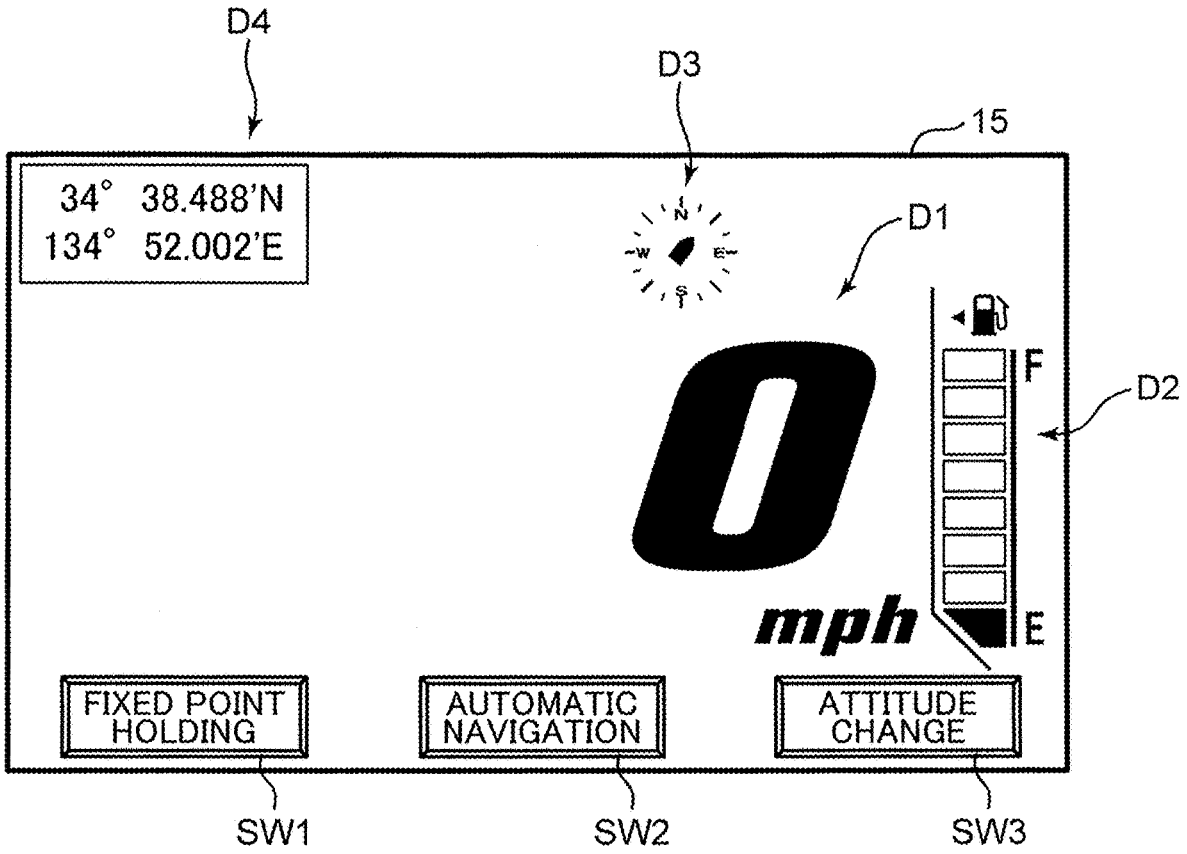
FIG. 19 is a view showing an example of an image displayed on a display.

The control device 100 is electrically connected to the display 15. The control device 100 receives a signal input to the display 15. Based on an operation or the like by the driver M, the control device 100 outputs a signal to the display 15 to change display content or a display format of the display 15. FIG. 19 is a display example of an image displayed on the display 15.

The display 15 displays a fixed point holding switch SW1, an automatic navigation switch SW2, and an attitude change switch SW3. The fixed point holding switch SW1 is a switch for causing the control device 100 to execute fixed point holding control described later. The automatic navigation switch SW2 is a switch for causing the control device 100 to execute automatic navigation control described later. The attitude change switch SW3 is a switch for causing the control device 100 to execute attitude change control described later.

For example, each of the switches SW1 to SW3 is switched to ON when a press operation is performed in a state of being OFF, and is switched to OFF when a press operation is performed in a state of being ON. The control device 100 changes a display format such as brightness of each of the switches SW1 to SW3 on the display 15 between a case of ON and a case of OFF so that the driver M can recognize whether each of the switches SW1 to SW3 is ON or OFF.

As shown in FIG. 19, the display 15 displays a speed D1 of the boat body 10, a remaining amount D2 of fuel, and the like, in addition to the switches SW1 to SW3. The display 15 displays a bow azimuth D3 calculated by the IMU 92. The display 15 displays a current position D4 of the PWC 1 specified by a position specification unit 102 described later.

The control device 100 is electrically connected to the engine 5, the jet nozzle 34 (nozzle motor 39), the reverse bucket 7 (bucket motor 49), and the thruster motor 59, and outputs control signals to these elements. By controlling them, the control device 100 controls the main propulsion device 2 and the auxiliary propulsion device 3. Specifically, by controlling elements such as a fuel jet device and an ignition plug included in the engine 5, the control device 100 controls the output of the engine 5 and the momentum of the jet water stream. By controlling the positions of the jet nozzle 34 and the reverse bucket 7, the control device 100 controls the direction of the propulsion force of the main propulsion device 2, that is, the direction of the jet water stream. By controlling the output and the rotation direction of the thruster motor 59, the control device 100 controls the momentum and the direction of the auxiliary water stream.

The control device 100 functionally includes a determination unit 101, the position specification unit 102, a fixed point holding control execution unit 111, an automatic navigation control execution unit 112, an attitude change control execution unit 113, an auxiliary navigation control execution unit 114, a stop control execution unit 115, and a normal navigation control execution unit 116.

The determination unit 101 is a module that performs various determinations regarding control of the PWC 1.

The position specification unit 102 is a module that performs control regarding the position of the PWC 1. The position specification unit 102 has, for example, a GPS function, and specifies the current position of the PWC 1 based on a signal from an artificial satellite.

The fixed point holding control execution unit 111 is a module that performs fixed point holding control. The fixed point holding control is control for keeping the boat body 10 within a predetermined range.

The automatic navigation control execution unit 112 is a module that performs automatic navigation control. The automatic navigation control is control for moving the boat body 10 toward the target position automatically, that is, without any operation by the driver M.

The attitude change control execution unit 113 is a module that performs attitude change control. The attitude change control is a control for changing the attitude of the boat body 10, that is, the orientation of the bow.

The auxiliary navigation control execution unit 114 is a module that performs auxiliary navigation control. The auxiliary navigation control is control for moving the boat body 10 based on the operation of the joystick 25.

The stop control execution unit 115 is a module that performs stop control. The stop control is control for imparting, to the boat body 10, a propulsion force in a direction in which inertial movement of the boat body 10 is prevented when boat body 10 is stopped.

The normal navigation control execution unit 116 is a module that performs normal navigation control. The normal navigation control is control for moving the boat body 10 only with the main propulsion device 2 based on the operations of the steering handle 13, the accelerator 21, and the shift lever 23.

The control device 100 switches the control modes of the main propulsion device 2 and the auxiliary propulsion device 3 among a plurality of modes. The control performed by the control device 100 will be described with reference to the flowchart of FIG. 20.

Figure 20:
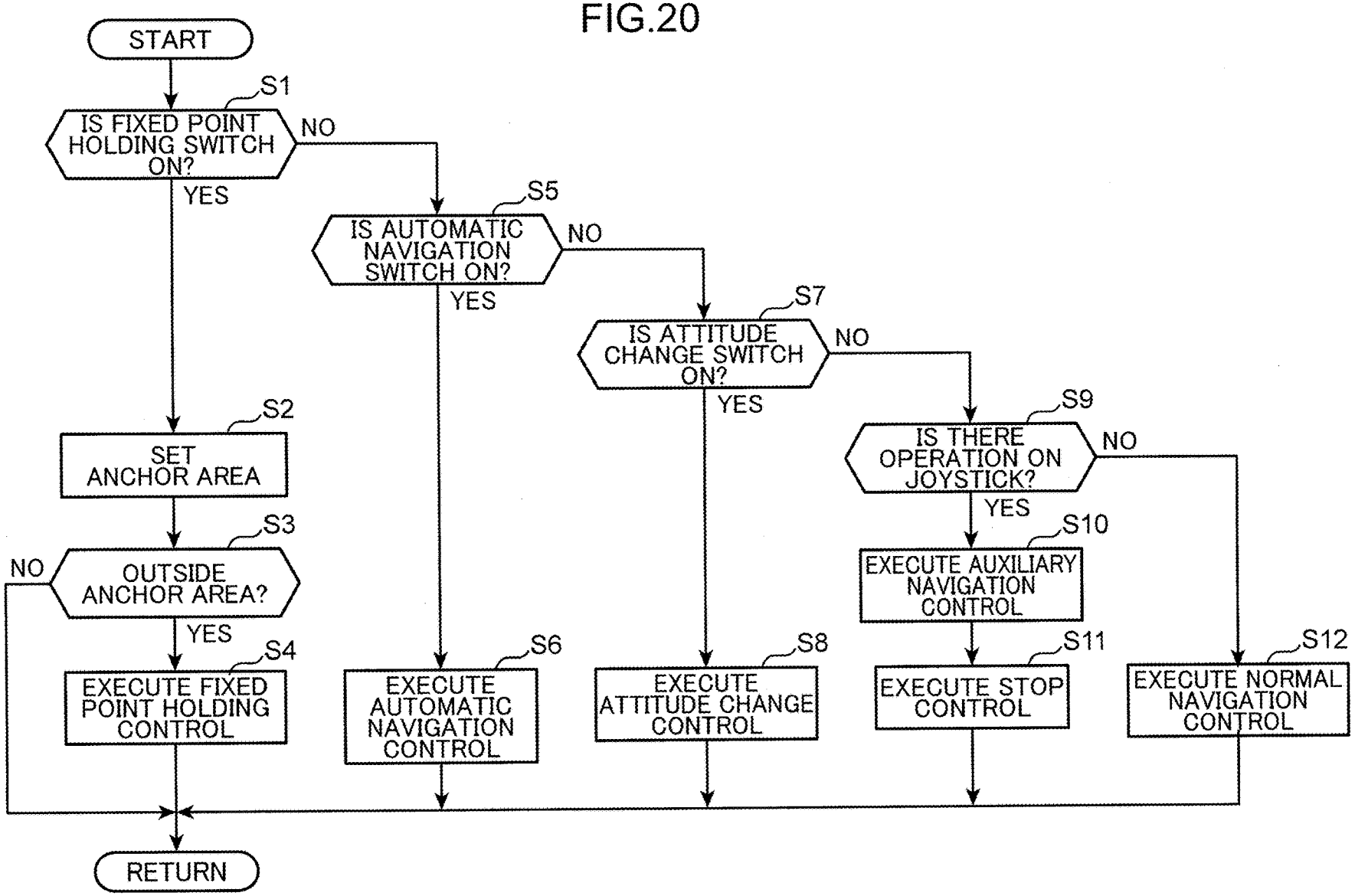
FIG. 20 is a flowchart showing control content performed by a control device.

The control shown in FIG. 20 is repeatedly performed at predetermined time intervals when the state of the PWC 1 is a navigable state.

When the control shown in FIG. 20 is started, the determination unit 101 determines whether or not the fixed point holding switch SW1 is ON (step S1). The determination unit 101 makes this determination based on a signal from the display 15.

If YES is determined in step S1 and the fixed point holding switch SW1 is ON, the determination unit 101 sets an anchor area (step S2). Specifically, the determination unit 101 stores, as the anchor point, the position of the PWC 1 specified by the position specification unit 102 when the fixed point holding switch SW1 is switched from OFF to ON. Next, the determination unit 101 sets, as the anchor area, an area in which a separation distance from an anchor point is equal to or less than a predetermined reference value.

Next, the determination unit 101 determines whether or not the current position of the boat body 10, that is, the current position of the PWC 1 is outside the anchor area (step S3). This determination is performed based on the position of the PWC 1 specified by the position specification unit 102. If this determination is NO and the current position of the boat body 10 is inside the anchor area, the control device 100 returns to step S1. On the other hand, if this determination is YES and the current position of the boat body 10 is outside the anchor area, the fixed point holding control execution unit 111 executes fixed point holding control described below (step S4). That is, the control device 100 sets the control mode to a fixed point holding control mode.

When the fixed point holding control is started, the fixed point holding control execution unit 111 controls each of the propulsion devices 2 and 3 so that the boat body 10 returns to the anchor area in a state where the orientation of the bow is maintained constant.

Specifically, the fixed point holding control execution unit 111 determines, as a return direction, a direction closest to the direction from the current position toward the anchor point among the eight slide directions. Among the eight slide patterns described above, a pattern in which the basic slide direction and the return direction match is determined as a return pattern. This determination is made based on the current position of the PWC 1 specified by the position specification unit 102, the position of the anchor point, and the orientation of the bow specified by the IMU 92. For example, when the return direction is determined to be diagonally right forward, the right front slide pattern is set as the return pattern.

Next, the fixed point holding control execution unit 111 performs, on each of the propulsion devices 2 and 3, control corresponding to the determined return pattern, that is, control in each slide pattern described above. For example, when the return pattern is the right front slide pattern, the fixed point holding control execution unit 111 drives both the engine 5 and the thruster motor 59. At this time, the fixed point holding control execution unit 111 rotates the thruster motor 59 forward, sets the position of the jet nozzle 34 to the first position, and sets the position of the reverse bucket 7 to the forward position. The fixed point holding control execution unit 111 adjusts the output of the engine 5 and the output of the thruster motor 59 such that the counterclockwise yaw moment caused by the jet water stream and the clockwise yaw moment caused by the auxiliary water stream cancel out each other. In the present embodiment, during execution of the fixed point holding control, the fixed point holding control execution unit 111 suppresses the outputs of the engine 5 and the thruster motor 59 to relatively small values within a range in which cancellation of the yaw moment is implemented so that the boat body 10 moves at a low speed.

The fixed point holding control mode is performed until the boat body 10 returns to the anchor area. The fixed point holding control mode corresponds to the "fixed point mode" in the present disclosure. The anchor area corresponds to the "target range" in the present disclosure.

Here, when the influence of wind or tide is large, there is a risk that the orientation of the bow changes during movement of the boat body 10. Therefore, when the fixed point holding control is started, the control device 100 performs bow azimuth return control of returning the orientation of the bow to a basic azimuth.

Specifically, when the fixed point holding control is started, the control device 100 stores, as the basic azimuth, the orientation of the bow when the fixed point holding control is started. The control device 100 calculates the deviation between the basic azimuth and the current orientation of the bow based on a signal from the IMU 92 during execution of the fixed point holding control. Specifically, the control device 100 calculates how many degrees the current bow tilts to the right or left direction with respect to the basic azimuth. Then, during execution of the fixed point holding control, when a bow deviation amount, which is the tilting with respect to the basic azimuth, becomes equal to or greater than a predetermined determination amount, the control device 100 executes the bow azimuth return control for returning the orientation of the bow to the basic azimuth.

Figure 21:
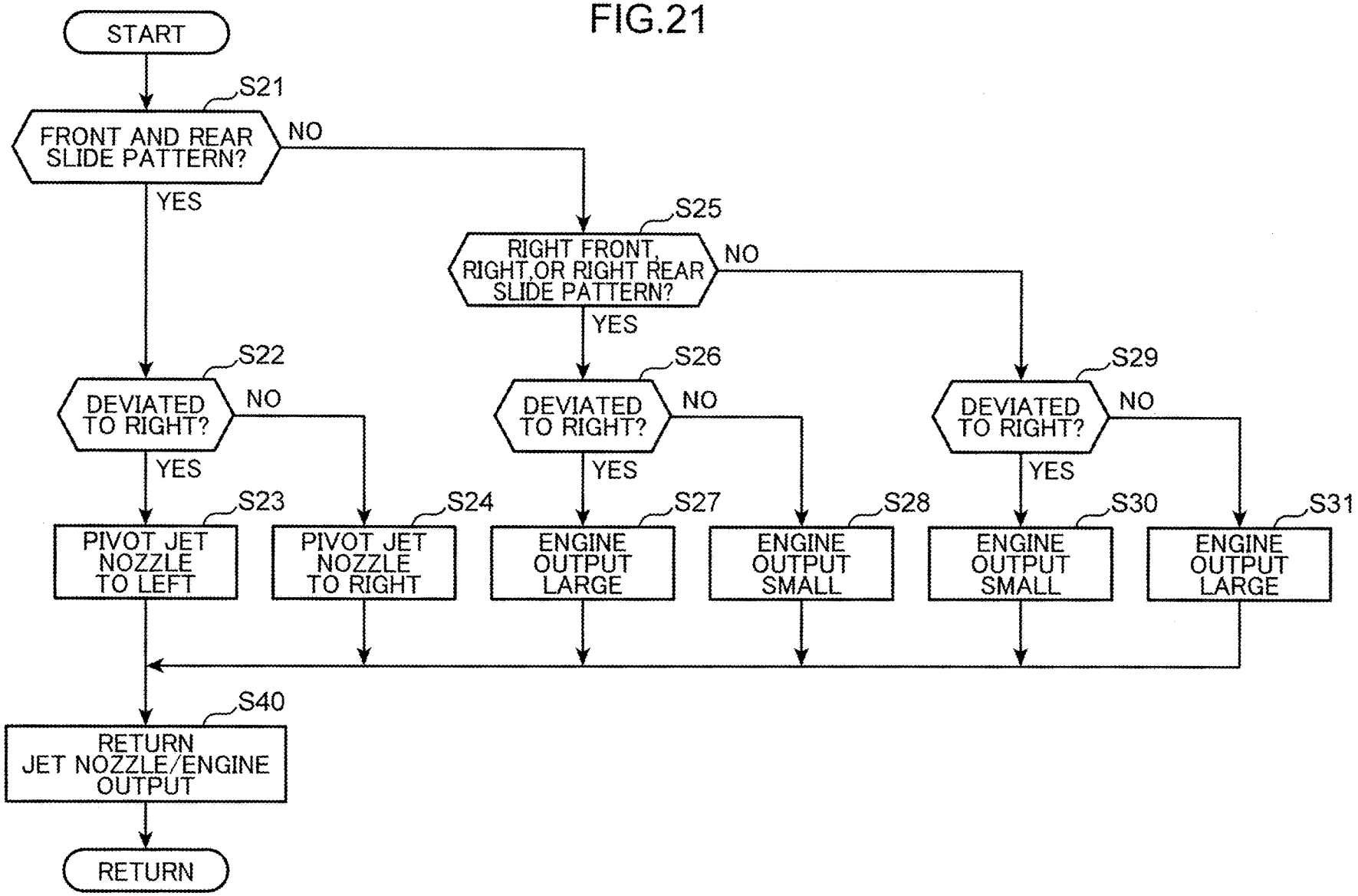
FIG. 21 is a flowchart showing content of bow azimuth return control.

FIG. 21 is a flowchart showing the bow azimuth return control.

When the bow azimuth return control is started, the control device 100 determines whether or not the current control pattern is any of the front slide pattern and the rear slide pattern (step S21). Note that during execution of the fixed point holding control, the return pattern having been set is the current control pattern.

If the determination in step S21 is YES, next, the control device 100 determines whether or not the orientation of the bow is deviated rightward with respect to the basic azimuth (step S22).

If the determination in step S22 is YES and the orientation of the bow is deviated to the right, the control device 100 pivots the jet nozzle 34 to the left (step S23). Due to this, the jet nozzle 34 is pivoted to the left from the basic position. On the other hand, if the determination in step S32 is NO and the orientation of the bow is deviated to the left, the control device 100 pivots the jet nozzle 34 to the right (step S24). Due to this, the jet nozzle 34 is pivoted to the right from the basic position. The pivot amount of the jet nozzle 34 implemented in steps S23 and S24 is set in advance, and the control device 100 pivots the jet nozzle 34 by this set amount. Note that the control device 100 continues the control before the start of the bow azimuth return control except for the position of the jet nozzle 34.

When the jet nozzle 34 pivots to the left from the basic position in a state where the current control pattern is the front slide pattern or the rear slide pattern, a counterclockwise yaw moment acts on the boat body 10. By this, by performing step S23, the boat body 10 moves forward or rearward while turning leftward, that is, toward the basic azimuth. When the jet nozzle 34 pivots to right from the basic position in a state where the control pattern is the front slide pattern or the rear slide pattern, a clockwise yaw moment acts on the boat body 10. By this, by performing step S24, the boat body 10 moves forward or rearward while turning rightward, that is, toward the basic azimuth.

If the determination in step S21 is NO, the control device 100 determines whether or not the current control pattern, that is, the currently set control pattern is set to any of the right front slide pattern, the right slide pattern, and the right rear slide pattern (step S25).

If the determination in step S25 is YES, next, the control device 100 determines whether or not the orientation of the bow is deviated rightward with respect to the basic azimuth (step S26).

If the determination in step S26 is YES and the orientation of the bow is deviated to the right, the control device 100 increases the output of the engine 5 (step S27). An output increase amount of the engine 5 is set in advance, and the output of the engine 5 is increased by this set amount. Note that the control device 100 continues the control before the start of the bow azimuth return control except for the output of the engine 5.

When the output of the engine 5 is increased in a state where the control pattern is the right slide pattern, the right slide pattern, or the right rear slide pattern, the counterclockwise yaw moment imparted to the rear end part of the boat body 10 increases. By this, when the control pattern is the right front slide pattern, the boat body 10 travels diagonally right forward while turning leftward, that is, toward the basic azimuth by performing step S27. When the control pattern is the right slide pattern, the boat body 10 travels to the right while turning to the left, that is, toward the basic azimuth. When the control pattern is the right rear slide pattern, the boat body 10 travels diagonally right rearward while turning to the left, that is, toward the basic azimuth.

On the other hand, if the determination in step S26 is NO and the orientation of the bow is deviated to the left, the control device 100 decreases the output of the engine 5 (step S28). An output decrease amount of the engine 5 is set in advance, and the output of the engine 5 is decreased by this set amount. Note that the control device 100 continues the control before the start of the bow azimuth return control except for the output of the engine 5.

When the output of the engine 5 is decreased in a state where the control pattern is the right front slide pattern, the right slide pattern, and the right rear slide pattern, the counterclockwise yaw moment imparted to the rear end part of the boat body 10 decreases. By this, when the control pattern is the right front slide pattern, the boat body 10 travels diagonally right forward while turning rightward, that is, toward the basic azimuth. When the control pattern is the right slide pattern, the boat body 10 travels to the right while turning to the right, that is, toward the basic azimuth. When the control pattern is the right rear slide pattern, the boat body 10 travels diagonally right rearward while turning to the right, that is, toward the basic azimuth.

When both steps S21 and S25 are NO, that is, when the control pattern is the left front slide pattern, the left slide pattern, or the left rear slide pattern, the control device 100 determines whether or not the orientation of the bow is deviated rightward with respect to the basic azimuth (step S29).

If the determination in step S29 is YES and the orientation of the bow is deviated to the right, the control device 100 decreases the output of the engine 5 (step S30). An output decrease amount of the engine 5 is set in advance, and the output of the engine 5 is decreased by this set amount. When the output of the engine 5 is decreased in a state where the control pattern is the left front slide pattern, the left slide pattern, or the left rear slide pattern, the clockwise yaw moment imparted to the rear end part of the boat body 10 decreases. By this, when the control pattern is the left front slide pattern, the boat body 10 travels diagonally left forward while turning leftward, that is, toward the basic azimuth. When the control pattern is the left slide pattern, the boat body 10 travels leftward while turning leftward, that is, toward the basic azimuth. When the control pattern is the left rear slide pattern, the boat body 10 travels diagonally right rearward while turning leftward, that is, toward the basic azimuth.

On the other hand, if the determination in step S29 is NO and the orientation of the bow is deviated to the left, the control device 100 increases the output of the engine 5 (step S31). An output increase amount of the engine 5 is set in advance, and the output of the engine 5 is increased by this set amount. When the output of the engine 5 is increased in a state where the control pattern is the left front slide pattern, the left slide pattern, or the left rear slide pattern, the clockwise yaw moment imparted to the rear end part of the boat body 10 increases. By this, when the control pattern is the right front slide pattern, the boat body 10 travels diagonally left forward while turning rightward, that is, toward the basic azimuth. When the control pattern is the left slide pattern, the boat body 10 travels to the left while turning to the right, that is, toward the basic azimuth. When the control pattern is the left rear slide pattern, the boat body 10 travels diagonally left rearward while turning to the right, that is, toward the basic azimuth.

When any of steps S23, S24, S27, S28, S30, and S31 is performed, the bow azimuth return control ends. When the bow azimuth return control ends, the control device 100 returns the position of the jet nozzle 34 or the output of the engine 5 to the original, and controls each of the propulsion devices 2 and 3 with the control pattern before the start of the bow azimuth return control. Specifically, when step S23 or step S34 is performed, the control device 100 returns the position of the jet nozzle 34 to the basic position. When any of steps S27, S28, S30, and S31 is performed, the control device 100 returns the output of the engine 5 to the original. That is, the engine 5 is decreased or increased by the set amount.

Note that the bow azimuth return control is executed every time the bow deviation amount becomes equal to or greater than the determination amount during execution of the fixed point holding control.

After step S3, the control device 100 returns to step S1. If the determination in step S1 is NO, the determination unit 101 determines whether or not the automatic navigation switch SW2 is ON (step S5). The determination unit 101 makes this determination based on a signal from the display 15.

If YES is determined in step S5 and the automatic navigation switch SW2 is ON, the automatic navigation control execution unit 112 executes the automatic navigation control described below (step S6). That is, the control device 100 switches the control mode to an automatic navigation mode.

When the automatic navigation control is started, first, the automatic navigation control execution unit 112 stores the target position of the boat body 10. In the present embodiment, the driver M can input the target position to the display 15. The automatic navigation control execution unit 112 stores the target position input to the display 15. For example, when the automatic navigation switch SW2 is switched from OFF to ON, the control device 100 displays a map on the display 15. The automatic navigation control execution unit 112 stores, as a target position, a point on the map pressed by the driver M.

After storing the target position, the automatic navigation control execution unit 112 controls the main propulsion device 2 and the auxiliary propulsion device 3 so that the boat body 10 moves toward the target position. The automatic navigation control execution unit 112 controls each of the propulsion devices 2 and 3 so that the boat body 10 reaches the target position in a state where the orientation of the bow is maintained constant.

Specifically, the automatic navigation control execution unit 112 determines, as an automatic navigation route, a route in which the traveling direction of the boat body 10 is implemented in any of the above-described eight slide directions or a route implemented by a combination of the routes and the route in which the boat body 10 can reach the target position in a shorter distance. This determination is performed based on the current position of the PWC 1 specified by the position specification unit 102, the target position, and the orientation of the bow specified by the IMU 92. The automatic navigation control execution unit 112 controls each of the propulsion devices 2 and 3 so that the boat body 10 moves along the determined automatic navigation route. That is, the automatic navigation control execution unit 112 controls each of the propulsion devices 2 and 3 while setting the control pattern to any of the eight slide patterns or switching the control pattern among the eight slide patterns. In the present embodiment, during execution of the automatic navigation control, the automatic navigation control execution unit 112 suppresses the outputs of the engine 5 and the thruster motor 59 to relatively small values so that the boat body 10 moves at a low speed.

The automatic navigation control is executed until the boat body 10 reaches the target position or until the automatic navigation switch SW2 is switched from ON to OFF.

Even during execution of the automatic navigation control, the bow azimuth return control is executed. Specifically, the automatic navigation control execution unit 112 stores, as the basic azimuth, the orientation of the bow when the automatic navigation switch SW2 is switched from OFF to ON. The control device 100 calculates the deviation between the basic azimuth and the current orientation of the bow based on a signal from the IMU 92 during execution of the automatic navigation control. Then, when the bow deviation amount becomes equal to or greater than the predetermined determination amount during execution of the automatic navigation control, the control device 100 interrupts the automatic navigation control and performs the bow azimuth return control. Note that when the bow azimuth return control ends, the automatic navigation control is resumed.

After step S6, the control device 100 returns to step S1. If the determination in step S1 is NO and the determination in step S5 is NO, the determination unit 101 determines whether or not the attitude change switch SW3 is ON (step S7). The determination unit 101 makes this determination based on a signal from the display 15.

If YES is determined in step S7 and the attitude change switch SW3 is ON, the attitude change control execution unit 113 executes the attitude change control described below (step S8). That is, the control device 100 switches the control mode to an attitude change mode.

When the attitude change control is started, the attitude change control execution unit 113 first stores a target attitude of the boat body 10. In the present embodiment, the driver M can input the turning direction and the turning angle of the boat body 10 to the display 15. For example, when attitude change switch SW3 is switched from OFF to ON, the control device 100 displays, on the display 15, an image in which the driver M can input the turning direction and the turning angle. The control device 100 receives an input operation on the display 15. The attitude change control execution unit 113 stores, as the target attitude, the turning direction and the turning angle input to the display 15. After storing the target attitude, the attitude change control execution unit 113 controls each of the propulsion devices 2 and 3 so that the boat body 10 turns by the input turning angle in the input turning direction.

Specifically, the attitude change control execution unit 113 stops the engine 5 and drives the thruster motor 59. At this time, when the turning direction input as the target attitude is right, the attitude change control execution unit 113 rotates the thruster motor 59 forward. On the other hand, when the input turning direction is left, the attitude change control execution unit 113 rotates the thruster motor 59 backward. Due to this, the boat body 10 turns on the spot without substantially traveling forward, rearward, leftward, or rightward. The attitude change control execution unit 113 continuously drives the thruster motor 59 until the turning angle of the boat body 10 reaches the angle of the target attitude. Note that the attitude change control execution unit 113 calculates the turning angle of the boat body 10 based on the orientation of the bow specified by the IMU 92. In the present embodiment, during execution of the attitude change control, the attitude change control execution unit 113 suppresses the output of the thruster motor 59 to a relatively small value so that the boat body 10 moves at a low speed.

When the turning angle of the boat body 10 reaches the angle of the target attitude, the attitude change control ends.

After step S8, the control device 100 returns to step S1. If all the determinations in step S1, step S5, and step S7 are NO, the determination unit 101 determines whether or not an operation has been performed on the joystick 25 (step S9).

Specifically, in a case where the joystick 25 is tilted with respect to the neutral position or is pivoted with respect to a predetermined pivoting neutral position, the determination unit 101 determines that the joystick 25 is operated. The determination unit 101 makes this determination based on a signal from the sensor incorporated in the joystick 25.

If YES is determined in step S9 and the joystick 25 is operated, the auxiliary navigation control execution unit 114 executes the auxiliary navigation control described below (step S10). That is, the control mode is set to the auxiliary navigation mode.

When the auxiliary navigation control is started, the auxiliary navigation control execution unit 114 determines a target traveling direction, which is a target traveling direction of the boat body 10, in response to the operation on the joystick 25, and controls each of the propulsion devices 2 and 3 so as to implement the target traveling direction. FIG. 22 is a tabular view showing the operation on the joystick 25, the control content of each of the propulsion devices 2 and 3, and the target traveling direction.

When the joystick 25 is pivoted rightward from the pivoting neutral position, the auxiliary navigation control execution unit 114 sets the target traveling direction of the boat body 10 to the clockwise direction. Then, the auxiliary navigation control execution unit 114 stops the engine 5 and drives the thruster motor 59. The auxiliary navigation control execution unit 114 rotates the thruster motor 59 forward. Due to this, the boat body 10 turns clockwise on the spot without substantially traveling forward, rearward, leftward, or rightward.

When the joystick 25 is pivoted leftward from the pivoting neutral position, the auxiliary navigation control execution unit 114 sets the target traveling direction of the boat body 10 to the counterclockwise direction. Then, the auxiliary navigation control execution unit 114 stops the engine 5 and drives the thruster motor 59. The auxiliary navigation control execution unit 114 rotates the thruster motor 59 backward. Due to this, the boat body 10 turns counterclockwise on the spot without substantially traveling forward, rearward, leftward, or rightward.

Here, the positions of the jet nozzle 34 and the reverse bucket 7 do not affect turning of the boat body 10. By this, these positions when the joystick 25 is pivoted are not limited, but in the present embodiment, when the joystick 25 is pivoted, the auxiliary navigation control execution unit 114 sets the position of the jet nozzle 34 to the basic position and sets the position of the reverse bucket 7 to the neutral position (N).

When the joystick 25 is tilted straight forward from the neutral position, the auxiliary navigation control execution unit 114 sets the target traveling direction of the boat body 10 forward. Then, the auxiliary navigation control execution unit 114 controls each of the propulsion devices 2 and 3 in the front slide pattern. Due to this, the boat body 10 travels forward.

When the joystick 25 is tilted straight rearward from the neutral position, the auxiliary navigation control execution unit 114 sets the target traveling direction of the boat body 10 rearward. Then, the auxiliary navigation control execution unit 114 controls each of the propulsion devices 2 and 3 in the rear slide pattern. Due to this, the boat body 10 travels rearward.

When the joystick 25 is tilted diagonally right forward, the auxiliary navigation control execution unit 114 sets the target traveling direction of the boat body 10 diagonally right forward. Then, the auxiliary navigation control execution unit 114 controls each of the propulsion devices 2 and 3 in the right front slide pattern. Due to this, the boat body 10 travels diagonally right forward.

When the joystick 25 is tilted rightward, the auxiliary navigation control execution unit 114 sets the target traveling direction of the boat body 10 rightward. Then, the auxiliary navigation control execution unit 114 controls each of the propulsion devices 2 and 3 in the right slide pattern. Due to this, the boat body 10 travels rightward.

When the joystick 25 is tilted diagonally right rearward, the auxiliary navigation control execution unit 114 sets the target traveling direction of the boat body 10 to diagonally right rearward. Then, the auxiliary navigation control execution unit 114 controls each of the propulsion devices 2 and 3 in the right rear slide pattern. Due to this, the boat body 10 travels diagonally right rearward.

When the joystick 25 is tilted diagonally left forward, the auxiliary navigation control execution unit 114 sets the target traveling direction of the boat body 10 diagonally left forward. Then, the auxiliary navigation control execution unit 114 controls each of the propulsion devices 2 and 3 in the left front slide pattern. Due to this, the boat body 10 travels diagonally left forward.

When the joystick 25 is tilted leftward, the auxiliary navigation control execution unit 114 sets the target traveling direction of the boat body 10 leftward. Then, the auxiliary navigation control execution unit 114 controls each of the propulsion devices 2 and 3 in the left slide pattern. Due to this, the boat body 10 travels leftward.

When the joystick 25 is tilted diagonally left rearward, the auxiliary navigation control execution unit 114 sets the target traveling direction of the boat body 10 diagonally left rearward. Then, the auxiliary navigation control execution unit 114 controls each of the propulsion devices 2 and 3 in the left rear slide pattern. Due to this, the boat body 10 travels diagonally left rearward.

Specific control content of the main propulsion device 2 and the auxiliary propulsion device 3 in each slide pattern are as described above, and the description thereof will be omitted here.

During execution of the auxiliary navigation control, that is, during the operation of the joystick 25, the auxiliary navigation control execution unit 114 adjusts the outputs of the engine 5 and the thruster motor 59 such that the speed of the boat body 10 increases as the tilt angle of the joystick 25 increases. Specifically, when both the engine 5 and the thruster motor 59 are driven, the auxiliary navigation control execution unit 114 increases the outputs of the engine 5 and the thruster motor 59 as the tilt angle of the joystick 25 is larger. When only one of the engine 5 and the thruster motor 59 is driven, the auxiliary navigation control execution unit 114 increases the output of the device being driven as the tilt angle of the joystick 25 is larger. However, the output of the engine 5 during execution of the auxiliary navigation control is made smaller than the minimum output of the engine 5 during normal navigation control execution described later and when the position of the reverse bucket 7 is the forward position or the reverse position. That is, the flow rate of the jet water stream during execution of the auxiliary navigation control is made smaller than the minimum value of the flow rate of the jet water stream during execution of the normal navigation control and during movement of the boat body 10. Due to this, the speed of the boat body 10 during execution of the auxiliary navigation control can be suppressed to be relatively low.

Figure 23:
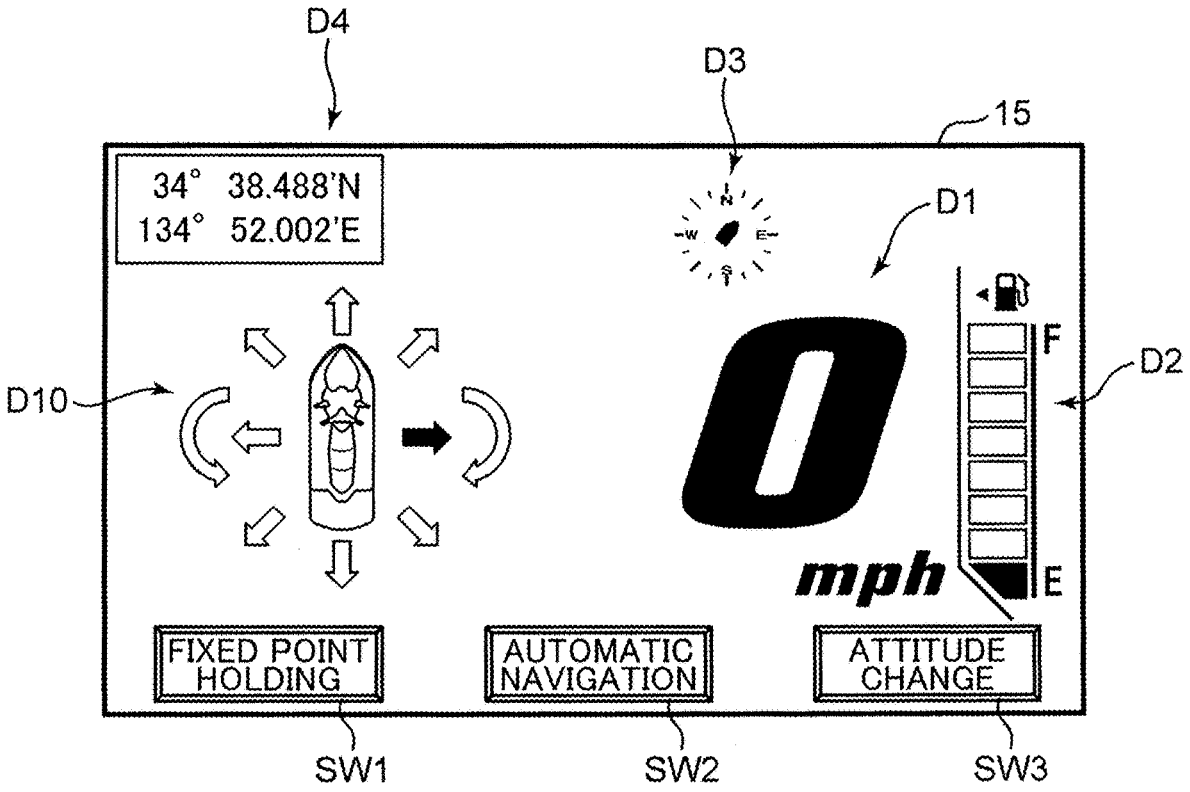
FIG. 23 is a view showing an example of an image displayed on the display when auxiliary navigation control is performed.

When the auxiliary navigation control is started, the auxiliary navigation control execution unit 114 displays, on the display 15, an image indicating that the auxiliary navigation control is being executed and an operation situation of the joystick 25. FIG. 23 is a view showing an image example of the display 15 during execution of the auxiliary navigation control. In the example shown in FIG. 23, when the auxiliary navigation control is started, the control device 100 displays, on the display 15, an image D10 including the boat body 10 and 10 arrows arranged around the boat body 10. With the image display, the driver M can recognize that the auxiliary navigation control is being executed. The displayed 10 arrows represent 10 operation directions of the joystick 25, respectively. The control device 100 makes the display format of the color, brightness, and the like of the arrow in the direction in which the joystick 25 is operated different from those of the other arrows. This enables the driver M to recognize the operation direction of the joystick 25. Note that FIG. 23 shows an example of a case where the joystick 25 is tilted rightward. When the auxiliary navigation control ends, the control device 100 stops display of the image D10 onto the display 15.

During execution of the auxiliary navigation control and when the joystick 25 is tilted, that is, when the control pattern is the slide pattern, the bow azimuth return control is executed. Specifically, the control device 100 stores, as the basic azimuth, the target traveling direction set based on the operation of the joystick 25. The control device 100 calculates the deviation between the basic azimuth and the current orientation of the bow based on a signal from the IMU 92 during execution of the auxiliary navigation control in a state where the joystick 25 is tilted. Then, when the bow deviation amount becomes equal to or greater than the predetermined determination amount, the control device 100 interrupts the auxiliary navigation control and performs the bow azimuth return control. Note that when the bow azimuth return control ends, the auxiliary navigation control is resumed.

The auxiliary navigation control ends when there is no operation on the joystick 25. When the auxiliary navigation control ends, the stop control execution unit 115 then starts the stop control (step S11). Here, even when the auxiliary navigation control ends, drive of the engine 5 and/or the thruster motor 59 that has already been driven is maintained. Note that a condition that the operation on the joystick 25 ends, and a condition that the auxiliary navigation control ends corresponds to the "predetermined stop condition" of the present disclosure.

When the stop control is started, the stop control execution unit 115 determines the direction of inertial movement of the boat body 10. The stop control execution unit 115 determines, as the direction of inertial movement, the target traveling direction immediately before the end of the auxiliary navigation control. The stop control execution unit 115 determines, as a stopping time target direction, a direction opposite to the determined direction of inertial movement. For example, when the joystick 25 is tilted diagonally right forward, the diagonally right forward is determined as the direction of inertial movement, and the diagonally left rearward is determined as the target direction. When the joystick 25 is pivotally operated rightward, the right turn is determined as the direction of inertial movement, and the left turn is determined as the target direction.

After determining the stopping time target direction, the stop control execution unit 115 executes the same control as the control performed to cause the boat body 10 to travel in the stopping time target direction when the auxiliary navigation control is executed. For example, when determining the diagonally left rearward as the stopping time target direction, the stop control execution unit 115 controls each of the propulsion devices 2 and 3 with the control pattern being the left rear slide pattern, similarly to when the auxiliary navigation control is executed and when the target traveling direction is the diagonally left rearward.

By this control, a propulsion force in a direction substantially opposite to the inertial force acting on the boat body 10 when the auxiliary navigation control ends is imparted to the boat body 10 from at least one of the main propulsion device 2 and the auxiliary propulsion device 3. As a result, the boat body 10 is restricted from moving with inertia even though the operation of the joystick 25 ends, and the boat body 10 is maintained in the vicinity of the position when the operation of the joystick 25 ends. The stop control execution unit 115 stops the engine 5 and the thruster motor 59 when execution time set in advance has elapsed since the start of the stop control. The execution time is set to a relatively short time.

After step S10, the control device 100 returns to step S1. If all the determinations in step S1, step S5, step S7, and step S9 are NO, the determination unit 101 executes the normal navigation control (step S12). That is, the control device 100 sets the control mode to a normal control mode.

When the normal navigation control is started, the normal navigation control execution unit 116 drives the engine 5. If the thruster motor 59 is driven, this is stopped. The normal navigation control execution unit 116 switches the position of the reverse bucket 7 among the forward position, the neutral position, and the reverse position based on the operation on the shift lever 23. Specifically, the normal navigation control execution unit 116 operates the bucket motor 49 based on a signal from the sensor incorporated in the shift lever 23. The normal navigation control execution unit 116 changes the position of the jet nozzle 34 based on an operation on the steering handle 13. Specifically, the normal navigation control execution unit 116 operates the nozzle motor 39 based on a signal from the sensor incorporated in the steering handle 13. The normal navigation control execution unit 116 increases or decreases the output of the engine 5 based on the operation on the accelerator 21. Specifically, the normal navigation control execution unit 116 controls the fuel jet device, the ignition plug, and the like included in the engine 5 based on a signal from the sensor incorporated in the accelerator 21.

Here, in the control mode in which the normal navigation control is executed and the position of the reverse bucket 7 is the forward position or the reverse position, the boat body 10 moves in a state where the engine 5 is driven and the thruster motor 59 is stopped. This control mode in which the normal navigation control is executed and the position of the reverse bucket 7 is the forward position or the reverse position corresponds to the "main control mode" of the present disclosure. In the control mode in which the auxiliary navigation control is executed and the control pattern is the special slide pattern, the boat body 10 moves in a state where both the engine 5 and the thruster motor 59 are driven. This control mode in which the auxiliary navigation control is executed and the control pattern is the special slide pattern corresponds to the "combined mode" of the present disclosure. The control mode when the auxiliary navigation control is executed and the joystick 25 is pivoted corresponds to the "turn mode" of the present disclosure.

Actions and Effects

As described above, in the PWC 1 of the present embodiment, in addition to the main propulsion device 2 that jets a jet water stream from the rear end part of the boat body 10, the auxiliary propulsion device 3 that imparts a leftward or rightward propulsion force to the boat body 10 is provided in the front end part of the boat body 10. Therefore, the degree of freedom in the moving direction of the boat body 10 is increased.

Specifically, only the engine 5 is driven as in forward/rearward of the boat body 10 during execution of the fixed point holding control, the automatic navigation control, and the auxiliary navigation control, whereby the boat body 10 can move forward/rearward. Since only the engine 5 is driven as during execution of the normal navigation control, the boat body 10 can be moved in any direction of the front, rear, left, and right. Furthermore, only the thruster motor 59 is driven as during execution of the attitude change control or when pivot operation of the joystick 25, whereby the boat body 10 can be turned rightward and leftward without substantially moving forward, rearward, leftward, and rightward. During the execution of the fixed point holding control, the automatic navigation control, and the auxiliary navigation control, and when the main propulsion device 2 and the auxiliary propulsion device 3 are controlled in the special slide pattern, it is possible to cause the boat body 10 to travel in a direction deviated from the front-rear direction while suppressing a change in yawing of the boat body 10 and eventually the orientation of the bow.

In the PWC 1 of the present embodiment, by adjustment of the rotation direction of the thruster motor 59, the position of the jet nozzle 34, and the position of the reverse bucket 7, it is possible to move the boat body 10 diagonally right forward, rightward, diagonally right rearward, diagonally left forward, leftward, and diagonally left rearward while suppressing the change in the orientation of the bow to be small. Therefore, movement in these directions can be implemented with a simple configuration.

In the PWC 1 of the present embodiment, during execution of the fixed point holding control, the automatic navigation control, and the auxiliary navigation control, when the orientation of the bow deviates and the deviation amount becomes equal to or greater than a predetermined determination amount, the bow azimuth return control for returning the orientation of the bow to the original is executed. Therefore, it is possible to suppress a significant change in the orientation of the bow during execution of each control described above.

In the PWC 1 of the present embodiment, the fixed point holding control is performed, and the main propulsion device 2 and the auxiliary propulsion device 3 are controlled so that the position of the boat body 10 returns to the set anchor area. Therefore, even when the influence of tide or the like on the boat body 10 is large, it is possible to prevent the boat body 10 from greatly deviating from a desired area.

In the PWC 1 of the present embodiment, the automatic navigation control is performed, and the main propulsion device 2 and the auxiliary propulsion device 3 are controlled so that the boat body 10 automatically moves to a set target position. Therefore, the boat body 10 can be moved to the target position while suppressing a load on the driver M to be small.

In the PWC 1 of the present embodiment, the attitude change control is performed, and the auxiliary propulsion device 3 is controlled so that the attitude of the boat body 10 automatically changes to a set target attitude. Therefore, the attitude of the boat body 10 can be the target attitude while suppressing a load on the driver M to be small.

In the PWC 1 of the present embodiment, the auxiliary propulsion device 3 is provided at a position deviated in the front-rear direction from the center of gravity G of the PWC 1, the position where the boat body 10 turns when the thruster motor 59 is driven in a state where the engine 5 is stopped. When the joystick 25 is pivoted at the time of performing the auxiliary navigation control, the engine 5 is stopped and only the thruster motor 59 is driven, whereby the boat body 10 turns. Therefore, the attitude of the boat body 10 can be easily changed to any attitude.

In the PWC 1 of the present embodiment, when the auxiliary navigation control ends, the stop control is executed, and the same control as when the boat body 10 is caused to travel in the direction opposite to the direction of inertial movement of the boat body 10 is executed. Therefore, after the end of the auxiliary navigation control, the boat body 10 is restricted from moving by its inertia, and the boat body 10 can be maintained in the vicinity of the position when the auxiliary navigation control ends.

In the PWC 1 of the present embodiment, the joystick 25 operable by the driver M is provided on the boat body 10 separately from the steering handle 13. When the normal navigation control is executed, the position and the like of the jet nozzle 34 are changed based on the operation on the steering handle 13. When the auxiliary navigation control is executed, the position and the like of the jet nozzle 34 are changed based on the operation on the joystick 25. Therefore, the driver M can easily recognize which control the driver M himself is operating.

In the PWC 1 of the present embodiment, when the auxiliary navigation control is executed, the target traveling direction is determined in response to the tilt direction of the joystick 25. Therefore, the driver M can output the target traveling direction to the control device 100 by a simple operation of tilting the joystick 25 in a desired direction.

In the PWC 1 of the present embodiment, when the auxiliary navigation control is started, a display that allows the driver M to recognize the fact that the auxiliary navigation control is started is displayed on the display 15. Therefore, the driver M can easily recognize that the auxiliary navigation control is being executed.

In the present embodiment PWC 1, the auxiliary propulsion device 3 is of an electric type and includes the thruster motor 59. Therefore, drive sound of the auxiliary propulsion device 3 can be suppressed to be small as compared with the case of using the engine as a drive source of the auxiliary propulsion device 3.

In the PWC 1 of the present embodiment, the flow rate of the jet water stream during execution of the auxiliary navigation control is made smaller than the flow rate of the jet water stream during execution of the normal navigation control and during movement of the boat body 10. Therefore, the flow rate of the auxiliary water stream necessary for canceling the yaw moment caused by the jet water stream can be suppressed to be small. Therefore, the special slide patterns can be implemented without increasing the flow rate of the auxiliary water stream. This makes it possible to reduce the size of the auxiliary propulsion device 3.

In the PWC 1 of the present embodiment, the display 15 displays the position of the boat body 10 and the orientation of the bow. Therefore, the number of components can be reduced as compared with a case where devices for displaying them are individually provided.

Modifications

The configuration for changing the orientation of the jet water stream is not limited to the configuration for changing the position of the jet nozzle 34 and the position of the reverse bucket 7.

In the above embodiment, the position where the main propulsion device 2 jets the jet water stream is not limited to the position more rearward than the seat 14 of the boat body 10. The position of the auxiliary propulsion device 3 is not limited to the position more forward than the seat 14 of the boat body 10.

For example, the position where the main propulsion device 2 jets a jet water stream and the position of the auxiliary propulsion device 3 may be provided on the same side in the front-rear direction with respect to the center of gravity G of the PWC 1. Also in this case, in addition to the main propulsion device 2, the auxiliary propulsion device 3 imparts the propulsion force in the lateral direction to the boat body 10, thereby increasing the yaw moment of the boat body 10. Therefore, the degree of freedom of movement of the boat body 10 is increased.

In the above embodiment, the timing at which the engine 5 and the thruster motor 59 are simultaneously driven is limited to the case where the control pattern is the special slide pattern. That is, when the thruster motor 59 is driven simultaneously with the engine 5, the thruster motor is controlled such that the yaw moment caused by the jet water stream is canceled by the yaw moment caused by the auxiliary water stream. The control configuration of the thruster motor 59 when the engine 5 and the thruster motor 59 are simultaneously driven is not limited to this. That is, the engine 5 and the thruster motor 59 may be simultaneously driven, and the thruster motor 59 may be controlled such that the yaw moment caused by the auxiliary water stream is in the same direction as the yaw moment caused by the jet water stream, and the yaw moment caused by the jet water stream is enhanced.

In the above embodiment, the case where the control pattern is the special slide pattern and the control mode in which the auxiliary navigation control is executed corresponds to the "combined mode" has been described. Alternatively, the case where the control pattern is the special slide pattern and the control mode in which the automatic navigation control or the fixed point holding control is performed may be defined as the "combined mode". The case where the control pattern is the special slide pattern, a control mode in which two or three of the three controls are performed may be defined as the "combined mode".

In the above embodiment, the stop control is performed only when the auxiliary navigation control ends. That is, the performance condition of the stop control is limited to the end time of the auxiliary navigation control. However, the performance condition of the stop control is not limited to this. For example, during execution of the fixed point holding control and when the engine 5 and/or the thruster motor 59 is stopped as the boat body 10 returns to the anchor area, the stop control may be executed assuming that the performance condition of the stop control is satisfied. During execution of the automatic navigation control and when the engine 5 and/or the thruster motor 59 is stopped as the boat body 10 reaches the target position, the stop control may be executed assuming that the performance condition of the stop control is satisfied. During execution of the attitude change control and when the engine 5 and/or the thruster motor 59 is stopped as the turning angle of the boat body 10 reaches the angle of the target attitude, the stop control may be executed assuming that the performance condition of the stop control is satisfied.

In the above embodiment, during execution of the auxiliary navigation control, the target traveling direction is determined by the tilt direction of the joystick 25. During execution of the auxiliary navigation control, the target turning direction is determined by the pivot direction of the joystick 25. However, a specific device for determining the target traveling direction and/or the target turning direction and operating the reverse bucket 7 and the like during execution of the auxiliary navigation control is not limited to the joystick 25. For example, in place of or in addition to the joystick 25, a switch displayed on the display 15 may be used as a device for determining the target traveling direction and/or the target turning direction.

In the above embodiment, switching between drive and stop of the thruster motor 59 and output adjustment of the thruster motor 59 are automatically performed by the control device 100. In place of or in addition to this, switching of drive and stop and output adjustment of the thruster motor 59 may be arbitrarily changed by the driver M.

In the above embodiment, an impeller (53, 63, 73) is used as a rotation element of the auxiliary propulsion device 3 that generates a water stream. The rotation element of the auxiliary propulsion device 3 is not limited to the impeller as long as it generates a water stream. This rotation element may be, for example, a screw or a propeller.

In the above embodiment, the auxiliary propulsion device 3 is provided inside the boat body 10. Alternatively, the auxiliary propulsion device 3 may be arranged outside the boat body 10. Similarly, the main propulsion device 2 may also be arranged outside the boat body 10.

In the above embodiment, the jet propulsion boat is the straddle-type jet propulsion boat (PWC 1) including the seat 14, but the jet propulsion boat may be a standup-type on which the driver aboard in a standing position. In a case where the joystick 25 or a device corresponding to the joystick 25 of the above embodiment, the device for determining the target traveling direction and/or a target turning direction during execution of the auxiliary navigation control and operating the reverse bucket 7 or the like, and the steering handle 13 are simultaneously operated, the operation of one of the joystick 25 or the device corresponding thereto and the steering handle 13 may be invalidated, and the boat body 10 may be navigated based on the operation of the other. For example, when the steering handle 13 is operated simultaneously with the operation of the joystick 25 or the device corresponding thereto, the operation of the steering handle 13 may be prioritized over the operation of the joystick 25 or the device corresponding thereto, and the boat body 10 may be navigated based on the operation of the steering handle 13. Similarly, in a case where the joystick 25 or the device corresponding thereto and the accelerator 21 are operated simultaneously, the operation of one of the joystick 25 or the device corresponding thereto and the accelerator 21 may be invalidated, and the boat body 10 may be navigated based on the operation of the other. For example, when the accelerator 21 is operated simultaneously with the operation of the joystick 25 or the device corresponding thereto, the operation of the accelerator 21 may be prioritized over the operation of the joystick 25 or the device corresponding thereto, and the boat body 10 may be navigated based on the operation of the accelerator 21. Furthermore, the operation of the steering handle 13 and the operation of the accelerator 21 may be prioritized over the operations of the fixed point holding switch SW1, the automatic navigation switch SW2, and the attitude change switch SW3. In place of or in addition to the steering handle 13 and the accelerator 21, an operator prioritized over the operation of the joystick 25 or the device corresponding thereto may be provided on the steering handle 13.

Summary

The above embodiment and modifications thereof include the following disclosure.

A jet propulsion boat according to one aspect of the present disclosure includes: a boat body; a main propulsion device including a jet device that jets a jet water stream from the boat body, and a direction change device that changes, in a lateral direction, an orientation of the jet water stream having been jetted; an auxiliary propulsion device provided on the boat body to impart a propulsion force in a lateral direction to the boat body; and a control device that controls the main propulsion device and the auxiliary propulsion device, and switches a control mode of the main propulsion device and the auxiliary propulsion device between a plurality of modes, in which the control mode includes a main control mode for driving the main propulsion device and stopping the auxiliary propulsion device to move the boat body, and a combined mode for driving both the main propulsion device and the auxiliary propulsion device to move the boat body.

According to the present disclosure, it is possible to impart a propulsion force in various directions and magnitudes to the boat body by a combination of the propulsion force imparted to the boat body by the main propulsion device and the propulsion force imparted to the boat body by the auxiliary propulsion device. The control mode is switched between the main mode and the combined mode, and the direction and the magnitude of the propulsion force imparted to the boat body are changed. Therefore, the degree of freedom of movement of the boat body is increased.

Preferably, the auxiliary propulsion device generates an auxiliary water stream directed outward in the lateral direction from the boat body, and when the control mode is the combined mode, the control device drives the main propulsion device such that a jet direction of the jet water stream has a lateral component, and drives the auxiliary propulsion device such that the auxiliary propulsion device imparts, to the boat body, a yaw moment in a direction opposite to a yaw moment to be imparted to the boat body by the main propulsion device.

According to this aspect, by the use of the auxiliary water stream, it is possible to move the boat body in a state of suppressing yawing of the boat body, that is, in a state of suppressing an excessive change in the orientation of the bow.

Preferably, when the control mode is the combined mode, the control device makes a flow rate of the jet water stream smaller than a flow rate when the control mode is the main control mode.

According to this aspect, the yaw moment imparted to the boat body by the main propulsion device can be canceled by the yaw moment caused by the auxiliary propulsion device without increasing the output of the auxiliary propulsion device.

Preferably, the jet device jets a jet water stream rearward from the boat body, and the direction change device deflects a rearward flow of the jet water stream to the lateral direction.

According to this aspect, the orientation of the jet water stream can be deflected by deflecting, in the lateral direction, the rearward flow of the jet water stream.

Preferably, the jet device includes a jet nozzle having a jet port opening rearward as an outlet of the jet water stream, and the direction change device includes a reverse bucket that is movable between a first position where the jet port is covered from rearward and a second position where the jet port is exposed, a bucket position change device that changes a position of the reverse bucket between the first position and the second position, and a nozzle drive device that tilts the jet nozzle in the lateral direction to change an orientation of the jet port.

According to this aspect, the orientation of the jet water stream can be changed in the lateral direction by changing the orientation of the jet port of the jet nozzle and the position of the reverse bucket.

Preferably, the jet propulsion boat includes a bow direction detection device that detects an orientation of a bow of the boat body, in which when the control mode is the combined mode, the control device controls the main propulsion device and the auxiliary propulsion device based on a detection result of the bow direction detection device.

According to this aspect, the boat body can be moved based on the orientation of the bow.

Preferably, the jet propulsion boat includes a position detection device mounted on the boat body to detect a position of the boat body, and a display device that displays a detection result of the position detection device, in which the display device displays a detection result of the bow direction detection device in addition to a detection result of the position detection device.

According to this aspect, the display device displays the position of the boat body and the orientation of the bow. Therefore, the number of components can be reduced as compared with a case where devices for displaying them are individually provided.

Preferably, the control mode includes a fixed point mode for controlling the main propulsion device and the auxiliary propulsion device such that a position of the boat body is maintained in a predetermined target range.

According to this aspect, the position of the boat body can be limited to an arbitrary target range.

Preferably, the jet propulsion boat includes a position detection device that detects a position of the boat body, in which the control mode includes an automatic navigation mode for controlling the main propulsion device and the auxiliary propulsion device such that the boat body moves to a predetermined target position based on a detection result of the position detection device.

According to this aspect, the boat body can be automatically moved to the target position.

Preferably, the jet propulsion boat includes a steering handle for operating the direction change device in the main control mode; and an auxiliary operator provided separately from the steering handle to operate the direction change device in the combined mode.

According to this aspect, it is easy for the driver to recognize as to which mode the operation is being performed.

Preferably, the auxiliary operator is a joystick, and the control device controls the auxiliary propulsion device in accordance with a tilt direction of the auxiliary operator.

According to this aspect, the auxiliary propulsion device can be operated with a simple procedure of tilting the joystick.

Preferably, the control device controls the main propulsion device and the auxiliary propulsion device such that a propulsion force in a direction in which inertial movement of the boat body is prevented is imparted to the boat body when a predetermined stop condition is satisfied.

According to this aspect, the stop position of the boat body 10 can be brought closer to the position intended by the driver.

Preferably, the jet propulsion boat includes a display device mounted on the boat body to display that the control mode is the combined mode when the control mode is the combined mode.

According to this aspect, the driver can easily recognize that the control mode is the combined mode.

Preferably, the auxiliary propulsion device includes an electric motor as a drive source.

According to this aspect, it is possible to reduce the drive sound of the auxiliary propulsion device.

Preferably, the boat body includes a seat on which a driver is seated, the jet device jets a jet water stream from a position more rearward than the seat of the boat body, and the auxiliary propulsion device is provided more forward than the seat of the boat body.

According to this aspect, it is possible to move the boat body while suppressing yawing.

Preferably, the auxiliary propulsion device is provided at a position where the boat body turns when the auxiliary propulsion device is driven in a state where the main propulsion device is stopped, and the control mode includes a turn mode for stopping the main propulsion device and driving the auxiliary propulsion device.

According to this aspect, it is possible to turn the boat body while suppressing the movement amount of the boat body forward, rearward, leftward, and rightward.

Preferably, the auxiliary propulsion device is provided at a position where the boat body turns when the auxiliary propulsion device is driven in a state where the main propulsion device is stopped, and the control mode includes an attitude change mode for stopping the main propulsion device and driving the auxiliary propulsion device, and controlling the auxiliary propulsion device such that a bow of the boat body is oriented in a predetermined target direction.

According to this aspect, it is possible to change the attitude of the boat body while suppressing the movement amount of the boat body forward, rearward, leftward, and rightward.

A method of controlling a jet propulsion boat according to one aspect of the present disclosure is a method of controlling a jet propulsion boat, the jet propulsion boat including a boat body, a main propulsion device including a jet device that jets a jet water stream from the boat body and a direction change device that changes an orientation of the jet water stream in a lateral direction, and an auxiliary propulsion device that imparts a propulsion force in the lateral direction to the boat body, the method including: switching a control mode of the boat body between a main control mode for driving the main propulsion device and stopping the auxiliary propulsion device and a combined mode for driving both the main propulsion device and the auxiliary propulsion device.

According to this method, it is possible to impart a propulsion force in various directions and magnitudes to the boat body by a combination of the propulsion force imparted to the boat body by the main propulsion device and the propulsion force imparted to the boat body by the auxiliary propulsion device. The control mode is switched between the main mode and the combined mode, and the direction and the magnitude of the propulsion force imparted to the boat body are changed. Therefore, the degree of freedom of movement of the boat body is increased.

Preferably, when the control mode is the combined mode, the main propulsion device is driven such that a jet direction of the jet water stream has a lateral component, and the auxiliary propulsion device is driven such that the auxiliary propulsion device imparts, to the boat body, a yaw moment in a direction opposite to a yaw moment to be imparted to the boat body by the main propulsion device.

According to this aspect, it is possible to move the boat body in a state of suppressing yawing of the boat body, that is, in a state of suppressing an excessive change in the orientation of the bow.

The invention claimed is:

1. A jet propulsion boat comprising:

a boat body; a main propulsion device including a jet device that jets a jet water stream from the boat body, and a direction change device that changes, in a lateral direction, an orientation of the jet water stream having been jetted;

an auxiliary propulsion device provided on the boat body to impart a propulsion force in a lateral direction to the boat body; and a control device that controls the main propulsion device and the auxiliary propulsion device, and switches a control mode of the main propulsion device and the auxiliary propulsion device between a plurality of modes, wherein the control mode includes a main control mode for driving the main propulsion device and stopping the auxiliary propulsion device to move the boat body, and a combined mode for driving both the main propulsion device and the auxiliary propulsion device to move the boat body;

wherein the auxiliary propulsion device in the combined mode, imparts, to the boat body, a yaw moment.

2. The jet propulsion boat according to claim 1, wherein the control mode includes a fixed point mode for controlling the main propulsion device and the auxiliary propulsion device such that a position of the boat body is maintained in a predetermined target range.

3. The jet propulsion boat according to claim 1 comprising a position detection device that detects a position of the boat body, wherein the control mode includes an automatic navigation mode for controlling the main propulsion device and the auxiliary propulsion device such that the boat body moves to a predetermined target position based on a detection result of the position detection device.

4. The jet propulsion boat according to claim 1, wherein the control device controls the main propulsion device and the auxiliary propulsion device such that a propulsion force in a direction in which inertial movement of the boat body is prevented is imparted to the boat body when a predetermined stop condition is satisfied.

5. The jet propulsion boat according to claim 1 comprising a display device mounted on the boat body to display that the control mode is the combined mode when the control mode is the combined mode.

6. The jet propulsion boat according to claim 1, wherein the auxiliary propulsion device includes an electric motor as a drive source.

7. The jet propulsion boat according to claim 1, wherein the boat body includes a seat on which a driver is seated, the jet device jets a jet water stream from a position more rearward than the seat of the boat body, and the auxiliary propulsion device is provided more forward than the seat of the boat body.

8. The jet propulsion boat according to claim 1, wherein the auxiliary propulsion device is provided at a position where the boat body turns when the auxiliary propulsion device is driven in a state where the main propulsion device is stopped, and the control mode includes a turn mode for stopping the main propulsion device and driving the auxiliary propulsion device.

9. The jet propulsion boat according to claim 1, wherein the auxiliary propulsion device is provided at a position where the boat body turns when the auxiliary propulsion device is driven in a state where the main propulsion device is stopped, and the control mode includes an attitude change mode for stopping the main propulsion device and driving the auxiliary propulsion device, and controlling the auxiliary propulsion device such that a bow of the boat body is oriented in a predetermined target direction.

10. The jet propulsion boat according to claim 1, wherein the auxiliary propulsion device generates an auxiliary water stream directed outward in the lateral direction from the boat body, and when the control mode is the combined mode, the control device drives the main propulsion device such that a jet direction of the jet water stream has a lateral component, and drives the auxiliary propulsion device such that the auxiliary propulsion device imparts, to the boat body, the yaw moment in a direction opposite to a yaw moment to be imparted to the boat body by the main propulsion device.

11. The jet propulsion boat according to claim 10, wherein when the control mode is the combined mode, the control device makes a flow rate of the jet water stream smaller than a flow rate when the control mode is the main control mode.

12. The jet propulsion boat according to claim 1, wherein the jet device jets a jet water stream rearward from the boat body, and the direction change device deflects a rearward flow of the jet water stream to the lateral direction.

13. The jet propulsion boat according to claim 12, wherein the jet device includes a jet nozzle having a jet port opening rearward as an outlet of the jet water stream, and the direction change device includes a reverse bucket that is movable between a first position where the jet port is covered from rearward and a second position where the jet port is exposed, a bucket position change device that changes a position of the reverse bucket between the first position and the second position, and a nozzle drive device that tilts the jet nozzle in the lateral direction to change an orientation of the jet port.

14. The jet propulsion boat according to claim 1 comprising a bow direction detection device that detects an orientation of a bow of the boat body, wherein when the control mode is the combined mode, the control device controls the main propulsion device and the auxiliary propulsion device based on a detection result of the bow direction detection device.

15. The jet propulsion boat according to claim 14 comprising:

a position detection device mounted on the boat body to detect a position of the boat body; and a display device mounted on the boat body to display a detection result of the position detection device and a detection result of the bow direction detection device.

16. The jet propulsion boat according to claim 1 comprising:

a steering handle for operating the direction change device in the main control mode; and an auxiliary operator provided separately from the steering handle to operate the direction change device in the combined mode.

17. The jet propulsion boat according to claim 16, wherein the auxiliary operator is a joystick, and the control device controls the auxiliary propulsion device in accordance with a tilt direction of the auxiliary operator.

18. A method of controlling a jet propulsion boat, the jet propulsion boat including a boat body, a main propulsion device including a jet device that jets a jet water stream from the boat body and a direction change device that changes an orientation of the jet water stream in a lateral direction, and an auxiliary propulsion device that imparts a propulsion force in the lateral direction to the boat body, the method comprising:

switching a control mode of the boat body between a main control mode for driving the main propulsion device and stopping the auxiliary propulsion device and a combined mode for driving both the main propulsion device and the auxiliary propulsion device;

wherein the auxiliary propulsion device in the combined mode, imparts, to the boat body, a yaw moment.

19. The method of controlling a jet propulsion boat according to claim 18, wherein when the control mode is the combined mode, the main propulsion device is driven such that a jet direction of the jet water stream has a lateral component, and the auxiliary propulsion device is driven such that the auxiliary propulsion device imparts, to the boat body, the yaw moment in a direction opposite to a yaw moment to be imparted to the boat body by the main propulsion device.

* * * * *